US009327536B2

(12) United States Patent
Suzuki et al.

(10) Patent No.: US 9,327,536 B2
(45) Date of Patent: May 3, 2016

(54) LIQUID EJECTION DEVICE, INSPECTION METHOD, AND PROGRAM

(71) Applicant: SEIKO EPSON CORPORATION, Tokyo (JP)

(72) Inventors: Toshiyuki Suzuki, Nagano (JP); Osamu Shinkawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/276,243

(22) Filed: May 13, 2014

(65) Prior Publication Data

US 2014/0247301 A1 Sep. 4, 2014

Related U.S. Application Data

(63) Continuation of application No. 13/406,047, filed on Feb. 27, 2012, now Pat. No. 8,757,748.

(30) Foreign Application Priority Data

Mar. 3, 2011 (JP) ..... 2011-045996

(51) Int. Cl.

| | |
|---|---|
| ***B41J 29/38*** | (2006.01) |
| ***B41J 29/393*** | (2006.01) |
| ***B41J 2/015*** | (2006.01) |
| ***B41J 2/045*** | (2006.01) |
| *B41J 2/14* | (2006.01) |

(52) U.S. Cl.

CPC ..... *B41J 29/393* (2013.01); *B41J 2/04506* (2013.01); *B41J 2/04581* (2013.01); *B41J 2002/14354* (2013.01)

(58) Field of Classification Search

USPC ..... 347/9, 19–20

See application file for complete search history.

(56) References Cited

U.S. PATENT DOCUMENTS

| | | | | |
|---|---|---|---|---|
| 7,150,513 | B2 | 12/2006 | Shinkawa et al. | |
| 7,328,960 | B2 | 2/2008 | Sakagami et al. | |
| 7,429,093 | B2 | 9/2008 | Shinkawa | |
| 7,458,654 | B2 | 12/2008 | Otsuka | |
| 7,597,417 | B2 | 10/2009 | Nagashima | |
| 2004/0095410 | A1 | 5/2004 | Miyashita | |
| 2005/0212845 | A1 * | 9/2005 | Shinkawa | 347/19 |
| 2011/0285772 | A1 | 11/2011 | Shinkawa | |

FOREIGN PATENT DOCUMENTS

| | | | |
|---|---|---|---|
| JP | 2004-160889 | A | 6/2004 |
| JP | 2004-276544 | A | 10/2004 |
| JP | 2004-351703 | A | 12/2004 |
| JP | 2005-185942 | A | 7/2005 |
| JP | 2005-238159 | A | 9/2005 |
| JP | 2005-289048 | A | 10/2005 |
| JP | 2005-305992 | A | 11/2005 |
| JP | 2006-001174 | A | 1/2006 |
| JP | 2006-306077 | A | 11/2006 |
| JP | 3901210 | B2 | 4/2007 |
| JP | 2010-058479 | A | 3/2010 |

* cited by examiner

*Primary Examiner* — Jason Uhlenhake

(74) *Attorney, Agent, or Firm* — Global IP Counselors, LLP

(57) ABSTRACT

A liquid ejection device comprising a plurality of ejection parts for ejecting liquid in cavities, an inspection part for inspecting the ejection parts. The ejection parts are classified into a plurality of ranks according to a characteristic of each of the ejection parts.

6 Claims, 15 Drawing Sheets

INSPECTION PRINT DATA

130

132

| INSPECTION SEQUENCE | INSPECTION TARGET (RANK) |
|---|---|
| 1 | #3(1) |
| 2 | #6(1) |
| 3 | #7(1) |
| ⋮ | ⋮ |
| 108 | #354 |
| 109 | #1(2) |
| 110 | #4(2) |
| 111 | #5(2) |
| ⋮ | ⋮ |
| 241 | #358(2) |
| 242 | #2(3) |
| 243 | #8(3) |
| 245 | #9(3) |
| ⋮ | ⋮ |
| 360(=n) | #360(3) |

Fig. 12

INSPECTION PRINT DATA

130

132

| INSPECTION SEQUENCE | INSPECTION TARGET (RANK) |
|---|---|
| 1 | #3(1) |
| 2 | #6(1) |
| 3 | #7(1) |
| 4 | #8(1) |
| 5 | #1(2) |
| 6 | #4(2) |
| 7 | #5(2) |
| 8 | #10(2) |
| 9 | #2(3) |
| 10 | #9(3) |
| 11 | #11(3) |
| 12 | #15(3) |
| 13 | #12(1) |
| ⋮ | ⋮ |
| 360(=n) | #358(2) |

Fig. 18

LIQUID EJECTION DEVICE, INSPECTION METHOD, AND PROGRAM

CROSS-REFERENCE TO RELATED APPLICATIONS

This application is a continuation application of U.S. patent application Ser. No. 13/406,047 filed on Mar. 13, 2012. This application claims priority to Japanese Patent Application No. 2011-045996 filed on Mar. 3, 2011. The entire disclosures of U.S. patent application Ser. No. 13/406,047 and Japanese Patent Application No. 2011-045996 are hereby incorporated herein by reference.

BACKGROUND

1. Technical Field

The present invention relates to a technique for inspecting a plurality of ejection parts in a liquid ejection device.

2. Background Technology

An inkjet printer as one example of a liquid ejection device includes a plurality of ejection parts for ejecting ink, and within the ejection parts, ink is stored in cavities communicated with nozzles, and ink is ejected from the nozzles by the driving of drive elements provided to the cavities. In the ejection part of such a liquid ejection device, when air bubbles get mixed in the ink in the cavities or when the ink in the cavities thickens, there is a risk of the nozzles becoming clogged and the ink not being ejected from the nozzles satisfactorily.

In the past, there has been proposed a technique for inspecting the clogging of the nozzles in the ejection parts on the basis of residual vibration remaining in the ink in the cavities due to the driving of the drive elements (see Patent Citations 1 through 3, for example). During inspection based on such residual vibration, when the plurality of ejection parts is inspected, there is variation in the residual vibration characteristics among the ejection parts as a result of positional relationship, manufacturing errors, and the like, and a determination reference of inspection based on residual vibration is therefore set in a range which allows variation in the residual vibration characteristics.

Japanese Patent Application Publication Nos. 2005-289048 (Patent Citation 1), 2005-305992 (Patent Citation 2) and 2006-306077 (Patent Citation 3) are examples of the related art.

SUMMARY

However, a well-known inspection based on residual vibration has had problems in that when the acceptable range of the determination reference is expanded too much according to the variation in residual vibration characteristics among the ejection parts, the distinction of whether or not there is clogging is vague, and there is a risk of erroneous determination in the inspection.

To overcome the problems described above, an advantage of the invention is to provide a technique whereby erroneous determination can be prevented when ejection parts are inspected based on residual vibration.

The invention was devised in order to achieve at least some of the advantages described above, and the invention can be implemented as the following modes or applied examples.

The liquid ejection device of the first aspect is characterized in including a plurality of ejection parts for ejecting liquid in cavities from nozzles communicated with the cavities, the liquid being ejected by the driving of a drive element, a detection part for detecting residual vibration, which is vibration of the liquid in the cavities and which remains due to the driving of the drive elements, and an inspection part for inspecting the ejection parts on the basis of a detection value of the residual vibration from the detection part; the liquid ejection device the ejection parts are classified into a plurality of ranks according to the residual vibration characteristics of the individual ejection parts.

In the liquid ejection device according to the above described aspect, the inspection part preferably performs inspection of the ejection parts based on the detection value in accordance with a determination reference corresponding to the ranks, the inspection being performed consecutively on those among the plurality of ejection parts that are classified in the same rank.

According to the liquid ejection device of this aspect, erroneous determination of the inspection resulting from excessive expansion of the acceptable range can be prevented by setting a determination reference for each of the ranks into which the ejection parts are classified so that there is less variation in the residual vibration characteristics, and increases in the processing load from using a determination reference according to rank can be suppressed by consecutively inspecting ejection parts of the same rank.

In the liquid ejection device of the above described aspect, the inspection part can perform inspection of the ejection parts based on the detection value in accordance with a determination reference corresponding to the ranks, and can perform the inspection consecutively on a predetermined number of the ejection parts for each of the ranks. According to the liquid ejection device of this aspect, the ejection parts of the various ranks can be inspected uniformly while ejection parts of the same rank are inspected consecutively.

The liquid ejection device of the above described aspects can further include a reference storage part for storing the determination reference in advance. According to the liquid ejection device of this aspect, inspection can be performed based on the determination reference stored in advance.

The liquid ejection device of any of the above described aspect can further include a reference creator for creating the determination reference in accordance with the characteristics of each of the ejection parts. According to the liquid ejection device of this aspect, the determination reference can be updated according to changes in the residual vibration characteristics.

The inspection method of one aspect is an inspection method for inspecting a plurality of ejection parts for ejecting liquid in cavities from nozzles communicated with the cavities, the liquid being ejected by the driving of a drive element, the inspection method including a detection step for detecting residual vibration, which is vibration of the liquid in the cavities and which remains due to the driving of the drive elements, and an inspection step for inspecting the ejection parts on the basis of a detection value of the residual vibration from the detection step; wherein the ejection parts are classified into a plurality of ranks according to the characteristics of individual ejection parts; and during the inspection, inspection of the ejection parts based on the detection value is performed in accordance with a determination reference corresponding to the ranks, the inspection being performed consecutively on those among the plurality of ejection parts that are classified in the same rank. According to the inspection method of this aspect, erroneous determination of the inspection resulting from excessive expansion of the acceptable range can be prevented by setting a determination reference for each of the ranks into which the ejection parts are classified so that there is less variation in the residual vibration characteristics, and increases in the processing load from using a determination reference according to rank can be suppressed by consecutively inspecting ejection parts of the same rank.

The program of one aspect is a program for causing a computer to run a function for inspecting a plurality of ejection parts for ejecting liquid in cavities from nozzles communicated with the cavities, the liquid being ejected by the driving of a drive element, the program characterized in running a detection function for detecting residual vibration, which is vibration of the liquid in the cavities and which remains due to the driving of the drive elements, and an inspection function for inspecting the ejection parts on the basis of a detection value of the residual vibration from the detection function; the ejection parts being classified into a plurality of ranks according to the characteristics of individual ejection parts; and the inspection function performing inspection of the ejection parts based on the detection value in accordance with a determination reference corresponding to the ranks, the inspection being performed consecutively on those among the plurality of ejection parts that are classified in the same rank. According to the program of this aspect, erroneous determination of the inspection resulting from excessive expansion of the acceptable range can be prevented by setting a determination reference for each of the ranks into which the ejection parts are classified so that there is less variation in the residual vibration characteristics, and increases in the processing load from using a determination reference according to rank can be suppressed by consecutively inspecting ejection parts of the same rank.

The liquid ejection device of one aspect includes a plurality of ejection parts for ejecting liquid in cavities from nozzles communicated with the cavities, the liquid being ejected by the driving of a drive element, a detection part for detecting the state of the liquid in the cavities, and an inspection part for inspecting the ejection parts on the basis of a detection value from the detection part; the liquid ejection device characterized in that the ejection parts are classified into a plurality of ranks according to the characteristics of the ejection parts; and the inspection part performs inspection of the ejection parts based on the detection value in accordance with a determination reference corresponding to the ranks, the inspection being performed consecutively on those among the plurality of ejection parts that are classified in the same rank.

In the liquid ejection device of the above described aspect, the inspection part can perform inspection of the ejection parts based on the detection value in accordance with a determination reference corresponding to the ranks, and can perform the inspection consecutively on a predetermined number of the ejection parts for each of the ranks.

The liquid ejection device of the above described aspects can further include a reference storage part for storing the determination reference in advance.

The liquid ejection device of any of the above described aspects can further include a reference creator for creating the determination reference in accordance with the characteristics in each of the ejection parts.

In the liquid ejection device of any of the above described aspects, the state of the liquid in the cavities can correspond to residual vibration, which is vibration of the liquid in the cavities and which remains due to the driving of the drive elements.

In the liquid ejection device of one aspect, the characteristics can be residual vibration characteristics in each of the ejection parts.

The inspection method of one aspect is an inspection method for inspecting a plurality of ejection parts for ejecting liquid in cavities from nozzles communicated with the cavities, the liquid being ejected by the driving of a drive element, the inspection method including a detection step for detecting the state of the liquid in the cavities, and an inspection step for inspecting the ejection parts on the basis of a detection value from the detection step; wherein the ejection parts are classified into a plurality of ranks according to the characteristics of individual ejection parts, and during the inspection, inspection of the ejection parts based on the detection value is performed in accordance with a determination reference corresponding to the ranks, the inspection being performed consecutively on those among the plurality of ejection parts that are classified in the same rank.

The computer-readable storage medium of one aspect is a computer-readable storage medium having stored thereon a program for causing a computer to run a function for inspecting a plurality of ejection parts for ejecting liquid in cavities from nozzles communicated with the cavities, the liquid being ejected by the driving of a drive element, wherein the program runs a detection function for detecting the state of the liquid in the cavities, and an inspection function for inspecting the ejection parts on the basis of a detection value from the detection function; wherein the ejection parts are classified into a plurality of ranks according to the characteristics of individual ejection parts, and the inspection function performs inspection of the ejection parts based on the detection value in accordance with a determination reference corresponding to the ranks, the inspection being performed consecutively on those among the plurality of ejection parts that are classified in the same rank.

The liquid ejection device of one aspect is a liquid ejection device for ejecting liquid from a plurality of ejection parts, the liquid ejection device including a plurality of drive elements driven by the application of a drive signal, and a detection part for detecting electrical signals outputted from the drive elements; wherein, in a case where the detection part consecutively detects electrical signals outputted from the drive elements, the detection part consecutively detects electrical signals outputted from the drive elements of those among the plurality of ejection parts that are of the same rank.

In the liquid ejection device of one aspect, in a case where the detection part consecutively detects electrical signals outputted from the drive elements, the detection part can consecutively detect electrical signals outputted from the drive elements of those among the plurality of ejection parts that are of the same rank.

The liquid ejection device of the above described aspects can include an inspection part for inspecting the ejection parts on the basis of a detection value from the detection part, and a reference storage part for storing a determination reference used in the inspection for each of the ranks.

The liquid ejection device of the above described aspects can include an inspection part for inspecting the ejection parts on the basis of a detection value from the detection part, and a reference creator for creating determination references used in the inspection for each of the ranks.

The liquid ejection device of any of the above described aspects, wherein the ranks of the respective ejection parts can be specified based on characteristics of residual vibration remaining due to the driving of the respective drive elements.

The inspection method of one aspect is an inspection method for ejecting liquid from a plurality of ejection parts of a liquid ejection device, the liquid ejection device including a plurality of drive elements driven by the application of a drive signal, and a detection part for detecting electrical signals outputted from the drive elements; wherein, in a case where electrical signals outputted from the drive elements are consecutively detected, electrical signals outputted from the drive elements of those among the plurality of ejection parts that are of the same rank are consecutively detected.

The computer-readable storage medium of one aspect is a computer-readable storage medium having stored thereon a program for causing a computer to run a function for inspecting a liquid ejection device for ejecting liquid from a plurality of ejection parts, the liquid ejection using a liquid ejection device including a plurality of drive elements driven by the application of a drive signal, and a detection part for detecting electrical signals outputted from the drive elements; wherein the program causes the computer to run the functions of detecting electrical signals outputted from the drive elements, and, in a case where electrical signals outputted from the drive elements are consecutively detected, consecutively detecting electrical signals outputted from the drive elements of those among the plurality of ejection parts that are of the same rank.

The modes of the invention are not limited to a liquid ejection device, an inspection method, and a program, and in addition to inkjet printers and other specific forms of liquid ejection devices, the invention can also be applied to forms such as ejection devices for ejecting fluid containing a solid dispersed in a liquid or gas. The invention is not limited to the modes previously described, and can of course be carried out in various forms within a range that does not deviate from the scope of the invention.

BRIEF DESCRIPTION OF THE DRAWINGS

Referring now to the attached drawings which form a part of this original disclosure:

FIG. 12 is a descriptive drawing showing an example of the inspection print data;

FIG. 18 is a descriptive drawing showing an example of inspection print data in the second example.

DETAILED DESCRIPTION OF EXEMPLARY EMBODIMENTS

To further clarify the configuration and effects of the invention described above, the following is a description of a liquid ejection device to which the invention is applied.

A. First Example

A1. Configuration of Printer

Figure 1:
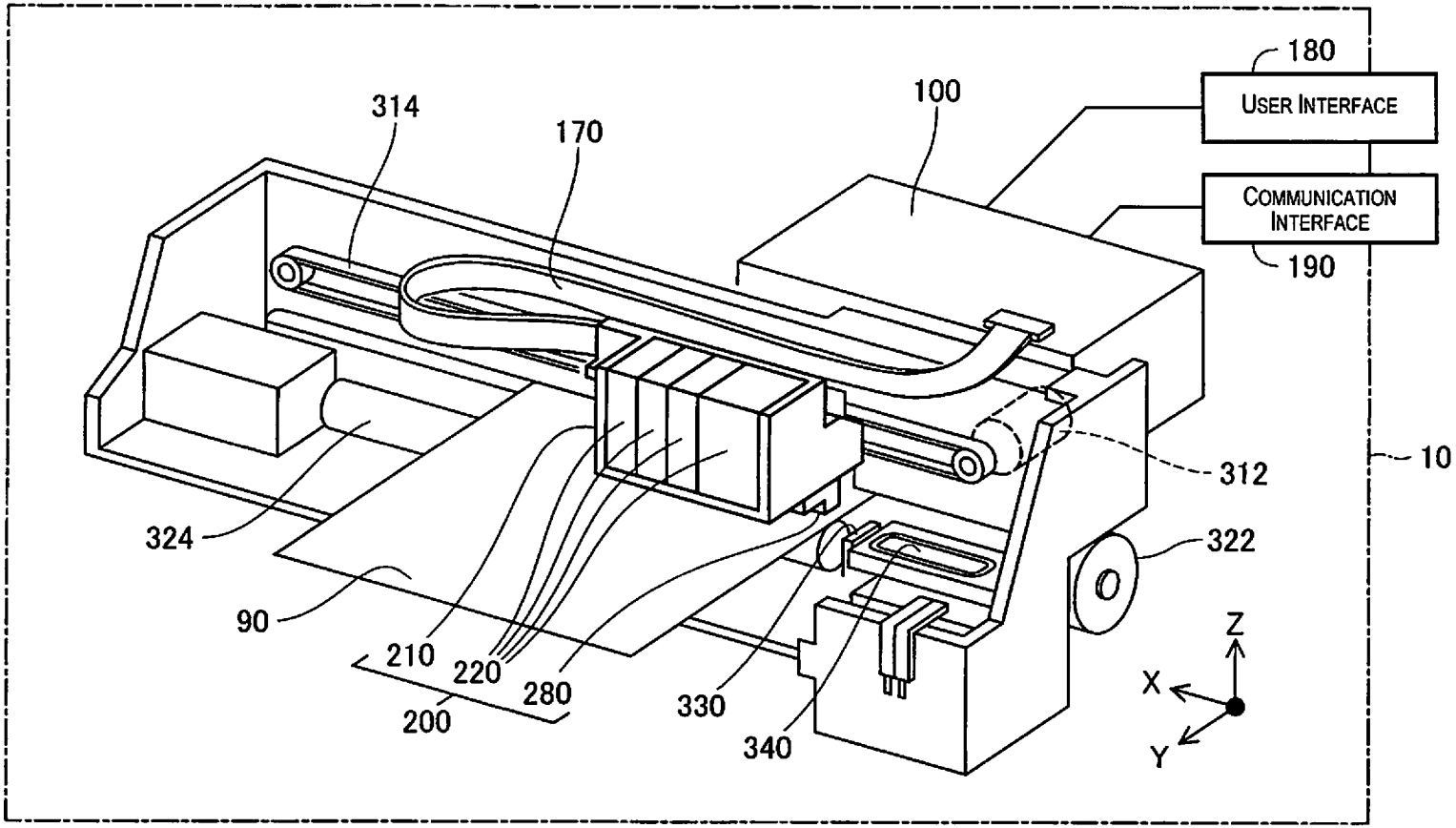
FIG. 1 is a descriptive drawing showing the configuration of the printer.

FIG. 1 is a descriptive drawing showing the configuration of a printer 10. The printer 10 is an inkjet printer as an example of a liquid ejection device for ejecting a liquid, and the printer prints characters, pictures, images, and other data on paper, a label, or another print medium 90 by ejecting ink as a liquid. The printer 10 includes a controller 100, a user interface 180, a communication interface 190, and a head unit 200.

The user interface 180 of the printer 10 includes a display and operation buttons, and conducts the exchange of information with the user of the printer 10. The communication interface 190 conducts the exchange of information with a personal computer, a digital still camera, a memory card, or another external device that can be electrically connected to the printer 10. The head unit 200 of the printer 10 includes an ink ejection mechanism for ejecting ink. The details of the ink ejection mechanism are described hereinafter.

The controller 100 of the printer 10 controls the other components of the printer 10. For example, based on data inputted via the communication interface 190, the controller 100 performs control for ejecting ink droplets from the head unit 200 while moving the head unit 200 and the print medium 90 relative to each other. Printing on the print medium 90 is thereby achieved.

In the present example, the controller 100 is a device including a CPU (Central Processing Unit), ROM (Read Only Memory), RAM (Random Access Memory), an input/output interface, and other components; and various functions of the controller 100 are implemented by the CPU operating based on a computer program. At least some of the functions of the controller 100 can be implemented by an electric circuit provided to the controller 100 operating based on the circuit configuration thereof.

In the present example, the head unit 200 includes a carriage 210, ink cartridges 220, and a head 280. The carriage 210 of the head unit 200 is connected to the controller 100 via a flexible cable 170, and is capable of moving with the ink cartridge 220 and the head 280 mounted thereon. The ink cartridges 220 of the head unit 200 store ink in their interiors, and supply the ink to the head 280. In the present example, a plurality of ink cartridges 220 prepared for each ink color (the four colors black, cyan, magenta, and yellow) are mounted on the carriage 210. The head 280 of the head unit 200 is a section that faces the print medium 90, and ink supplied from the ink cartridges 220 to the head 280 is ejected in the form of droplets from the head 280 onto the print medium 90.

In the present example, the printer 10 includes a main scan feed mechanism and a sub scan feed mechanism in order to move the head unit 200 and the print medium 90 relative to each other. The main scan feed mechanism of the printer 10 includes a carriage motor 312 and a drive belt 314, and the power of the carriage motor 312 is transmitted to the head unit 200 through the drive belt 314, thereby causing the head unit 200 to reciprocate in the main scan direction. The sub scan feed mechanism of the printer 10 includes a conveying motor 322 and a platen 324, and the power of the conveying motor 322 is transmitted to the platen 324, thereby conveying the print medium 90 in the sub scan direction which intersects the main scan direction. The carriage motor 312 of the main scan feed mechanism and the conveying motor 322 of the sub scan feed mechanism operate based on control signals from the controller 100.

In the description of the present example, the X axis is set on the coordinate axis running along the main scan direction in which the head unit 200 is reciprocated, the Y axis is set on the coordinate axis running along the sub scan direction in which the print medium 90 is conveyed, and the Z axis is set on the coordinate axis running from the bottom upward in the direction of gravity. The X axis, Y axis, and Z axis are coordinate axes orthogonal to each other.

Figure 2:
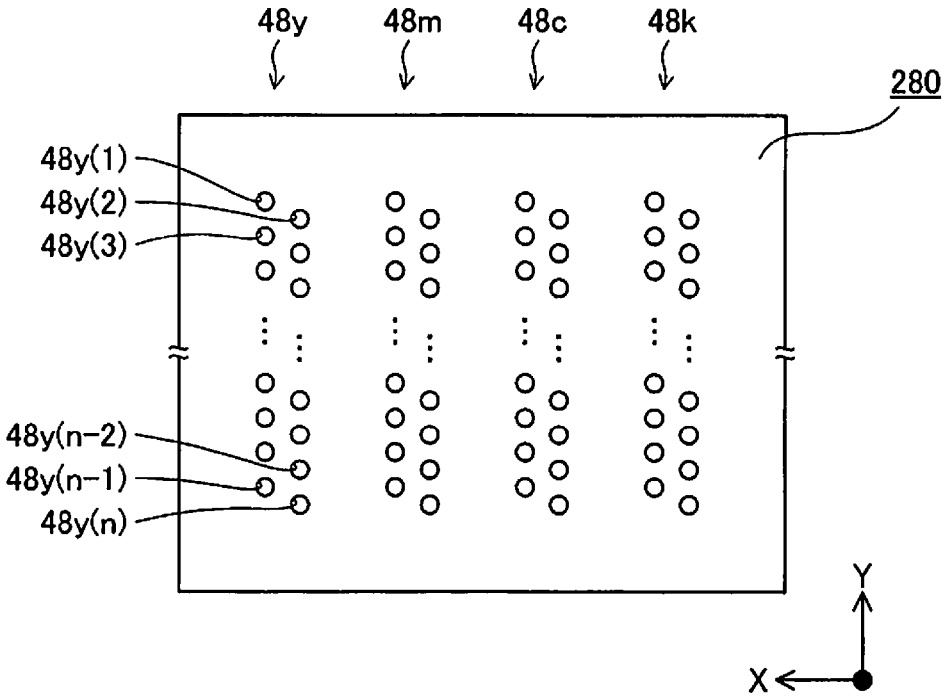
FIG. 2 is a descriptive drawing showing the structure of the head in the head unit.

FIG. 2 is a descriptive drawing showing the structure of the head 280 in the head unit 200. FIG. 2 shows the head 280 as seen from the print medium 90. The head 280 of the head unit 200 includes a plurality of nozzles 48 for ejecting ink. In the present example, n (e.g. 360) nozzles 48 are provided for each ink color (the four colors black, cyan, magenta, and yellow), and the nozzles 48 of the different colors are arranged in the sequence black, cyan, magenta, and yellow in the main scan direction (the X axis direction). The n nozzles 48 of the different colors are arrayed as being staggered from each other in the sub scan direction (the Y axis direction), and in the present example, the nozzles 48 are arrayed in two alternating rows along the sub scan direction (the Y axis direction) in order to narrow the spaces between nozzles 48 in the sub scan direction (the Y axis direction).

In the description of the present example, the symbol "48" is used when collectively referring to the nozzles in the head unit 200, the symbol "48*k*" is used when specifying black nozzles, the symbol "48*c*" is used when specifying cyan nozzles, the symbol "48*m*" is used when specifying magenta nozzles, and the symbol "48*y*" is used when specifying yellow nozzles. Furthermore, a symbol including a nozzle number is used when specifying individual nozzles. For example, the symbol "48*y*(1)" is used for the first yellow nozzle, the symbol "48*y*(2)" is used for the second yellow nozzle, the symbol "48*y*(3)" is used for the third yellow nozzle, . . . , the symbol "48*y*(n−1)" is used for the $(n-1)^{th}$ yellow nozzle, and the symbol "48*y*(n)" is used for the $n^{th}$ yellow nozzle, as shown in FIG. 2.

Figure 3:
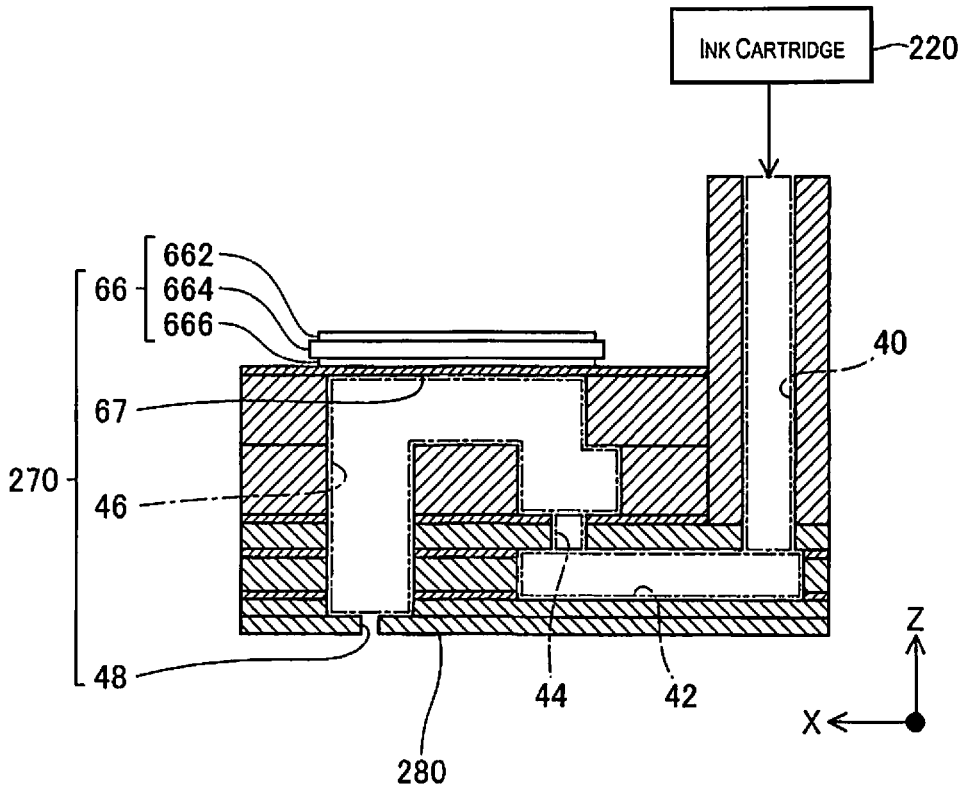
FIG. 3 is a descriptive drawing showing the ink ejection mechanism in the head unit.

FIG. 3 is a descriptive drawing showing the ink ejection mechanism in the head unit 200. FIG. 3 shows a cross section of the head 280, divided along the direction of gravity (the Z axis direction). The ink ejection mechanism of the head unit 200 includes an inlet passage 40, a reservoir 42, a supply port 44, a cavity 46, a nozzle 48, a drive element 66, and a vibrating plate 67.

An inlet passage 40 and reservoir 42 of the ink ejection mechanism are provided for each ink color, forming part of the flow passage through which ink flows from the ink cartridge 220 to the nozzle 48. Ink supplied from the ink cartridge 220 to the head unit 200 passes through the inlet passage 40 to be retained in the reservoir 42.

A supply port 44, a cavity 46, a drive element 66, and a vibrating plate 67 of an ink ejection mechanism are provided corresponding to each of the plurality of nozzles 48 formed in the head 280, and these components together with a nozzle 48 constitute an ejection part 270. In other words, the head unit 200 includes a plurality of ejection parts 270 corresponding to the number of plurality of nozzles 48. Through the driving of the drive element 66, the ejection part 270 ejects the ink in the cavity 46 from the nozzle 48 communicated with the cavity 46.

The supply port 44 and the cavity 46 of the ejection part 270 form part of the flow passage through which ink flows from the ink cartridge 220 to the nozzle 48. The supply port 44 is a flow passage communicating the reservoir 42 and the cavity 46, whereby ink is supplied from the reservoir 42 to the cavity 46 through the supply port 44. The cavity 46, which is a flow passage communicated with the nozzle 48, has a flow passage cross section sufficiently larger than the supply port 44 and the nozzle 48 and retains ink before the ink is ejected.

The drive element 66 of the ejection part 270 is provided to the cavity 46 on the other side of the vibrating plate 67, and the vibrating plate 67 of the ejection part 270 forms part of the flow passage wall surface in the cavity 46. In the present example, the drive element 66 is a unimorphic piezoelectric actuator in which a piezoelectric element 664 is stacked between two electrodes 662, 666 and the vibrating plate 67 is provided on the side of the electrode 666, but in another embodiment, a stacked piezoelectric actuator can be applied in the drive element 66. The drive element 66 flexes in the direction of gravity (the Z axis direction) on the basis of the application of a drive signal, displacing the vibrating plate 67. The volume of the cavity 46 thereby expands, drawing ink in from the reservoir 42, after which the volume of the cavity 46 can be contracted to eject ink droplets from the nozzle 48.

Returning to the description of FIG. 1, in the present example, the printer 10 includes a head wiper 330 and a head cap 340 as a mechanism for maintenance of the head 280 of the head unit 200. The head wiper 330 of the printer 10 removes ink adhering to the head 280 by wiping the head 280. When the nozzle 48 of the ejection part 270 has become clogged by ink degraded by air bubbles or thickening, the head cap 340 of the printer 10 restores the ejection part 270 to be capable of appropriately ejecting ink by attaching to the head 280 and sucking out the degraded ink from the nozzle 48.

Figure 4:
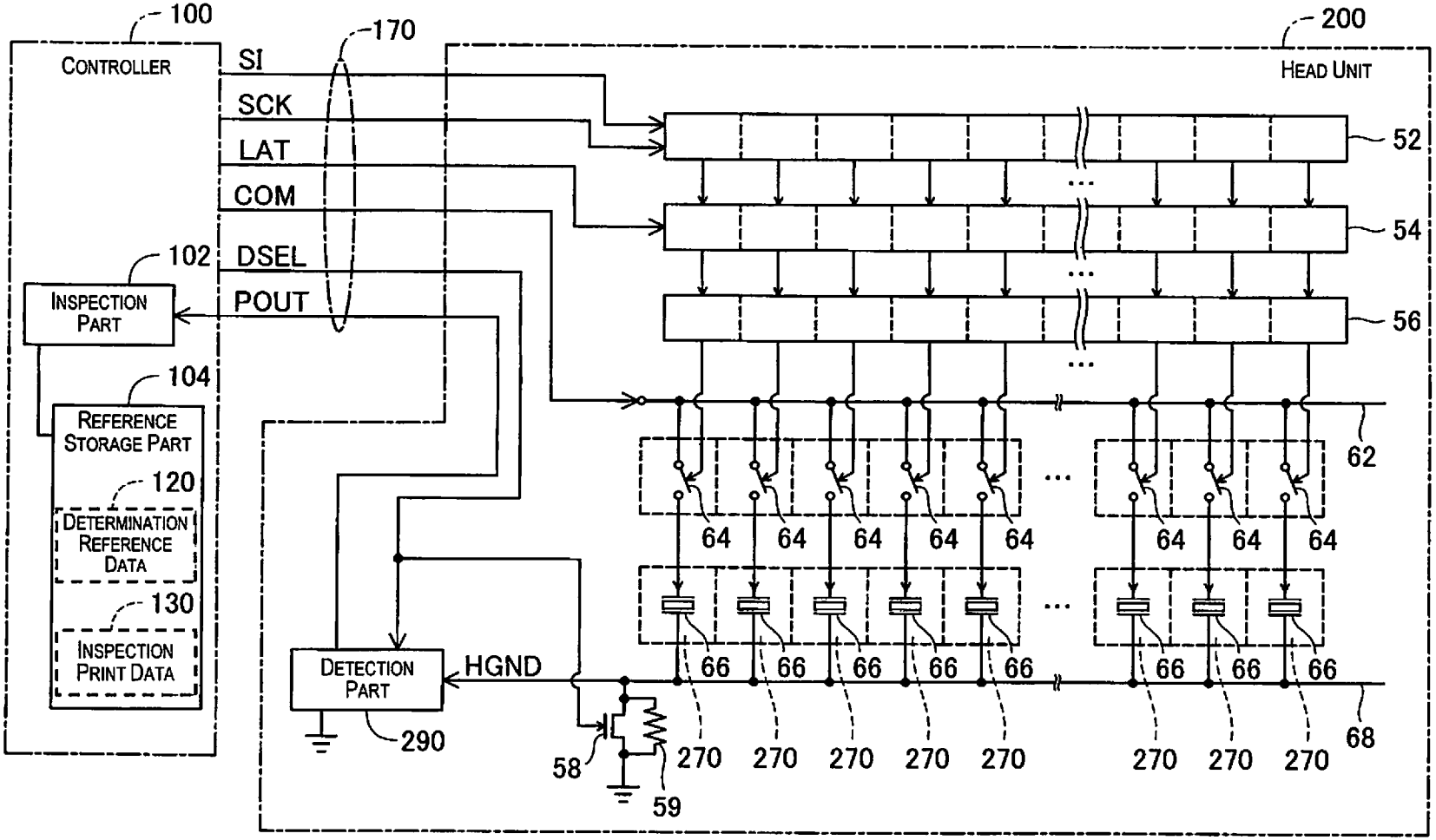
FIG. 4 is a descriptive drawing showing the electrical configuration of the controller and head unit.

FIG. 4 is a descriptive drawing showing the electrical configuration of the controller 100 and head unit 200. The controller 100 includes an inspection part 102 and a reference storage part 104, and the head unit 200 includes a shift register 52, a latch circuit 54, a level shifter 56, a switch 58, shared electrical circuits 62, 68, a plurality of switches 64, and a detection part 290.

The shift register 52 of the head unit 200 is a storage device for holding instruction data for instructing the actions of the drive elements 66 in the plurality of ejection parts 270. In a shift input signal SI from the controller 100, instruction data corresponding to the drive elements 66 is sequentially outputted in synchronization with a clock signal SCK, and instruction data corresponding to the drive elements 66 is sequentially stored in the shift register 52 on the basis of the shift input signal SI and the clock signal SCK. In the present example, the instruction data corresponding to the drive elements 66 is 2-bit data indicating one of the sets [0, 0], [0, 1], [1, 0], or [1, 1].

Based on a latch signal LAT from the controller 100, the latch circuit 54 of the head unit 200 holds instruction data of the drive elements 66 stored in the shift register 52 and outputs a logic signal corresponding to the instruction data to the level shifter 56. The latch signal LAT is outputted from the controller 100 at the timings with which all of the instruction data of the drive elements 66 is stored in the shift register 52. In the present example, the latch circuit 54 outputs a Lo level logic signal in response to the instruction data [0, 0], a Hi level logic signal as a continuation of the Lo level in response to the instruction data [0, 1], a Lo level logic signal as a continuation of the Hi level in response to the instruction data [1, 0], and a Hi level logic signal in response to the instruction data [1, 1].

According to the logic signals outputted from the latch circuit 54, the level shifter 56 of the head unit 200 outputs voltages of levels capable of turning the switches 64 on and off to each of the switches 64 connected to the drive elements 66. In the present example, the level shifter 56 outputs a voltage of a level that turns a switch 64 off in response to a Lo level logic signal from the latch circuit 54, and outputs a voltage of a level that turns a switch 64 on in response to a Hi level logic signal from the latch circuit 54.

The plurality of switches 64 in the head unit 200 turn the electrical connection on and off between the shared electrical circuit 62 and the drive elements 66. A drive signal COM for driving the drive elements 66 is inputted to the shared electrical circuit 62 of the head unit 200 from the controller 100. During an on state in which the drive elements 66 are electrically connected to the shared electrical circuit 62 by the switches 64, the drive signal COM is applied to the electrode 662 side of the drive elements 66, and during an off state in which the drive elements 66 are electrically blocked from the shared electrical circuit 62 by the switches 64, the drive signal COM is not applied to the drive elements 66. In the present example, the switches 64 are analog switches using a transmission gate.

The switch 58 of the head unit 200 connects to ground (grounds) the shared electrical circuit 68 electrically connected to the electrode 666 side of the drive elements 66. In the present example, between the shared electrical circuit 68 and ground, a resistance 59 is electrically connected in parallel with the switch 58. The switch 58 electrically blocks the shared electrical circuit 68 from ground on the basis of a detection operation signal DSEL outputted from the controller 100, during which time the detection part 290 detects an electric signal HGND outputted from the shared electrical circuit 68 through a voltage change amplified by an op-amp, the voltage change being based on electric current flowing to the resistance 59. The detection part 290 can thereby effectively detect electromotive force applied from the drive elements 66 to the shared electrical circuit 68, on the basis of a voltage change between the electric signal HGND of the shared electrical circuit 68 and ground.

Figure 5:
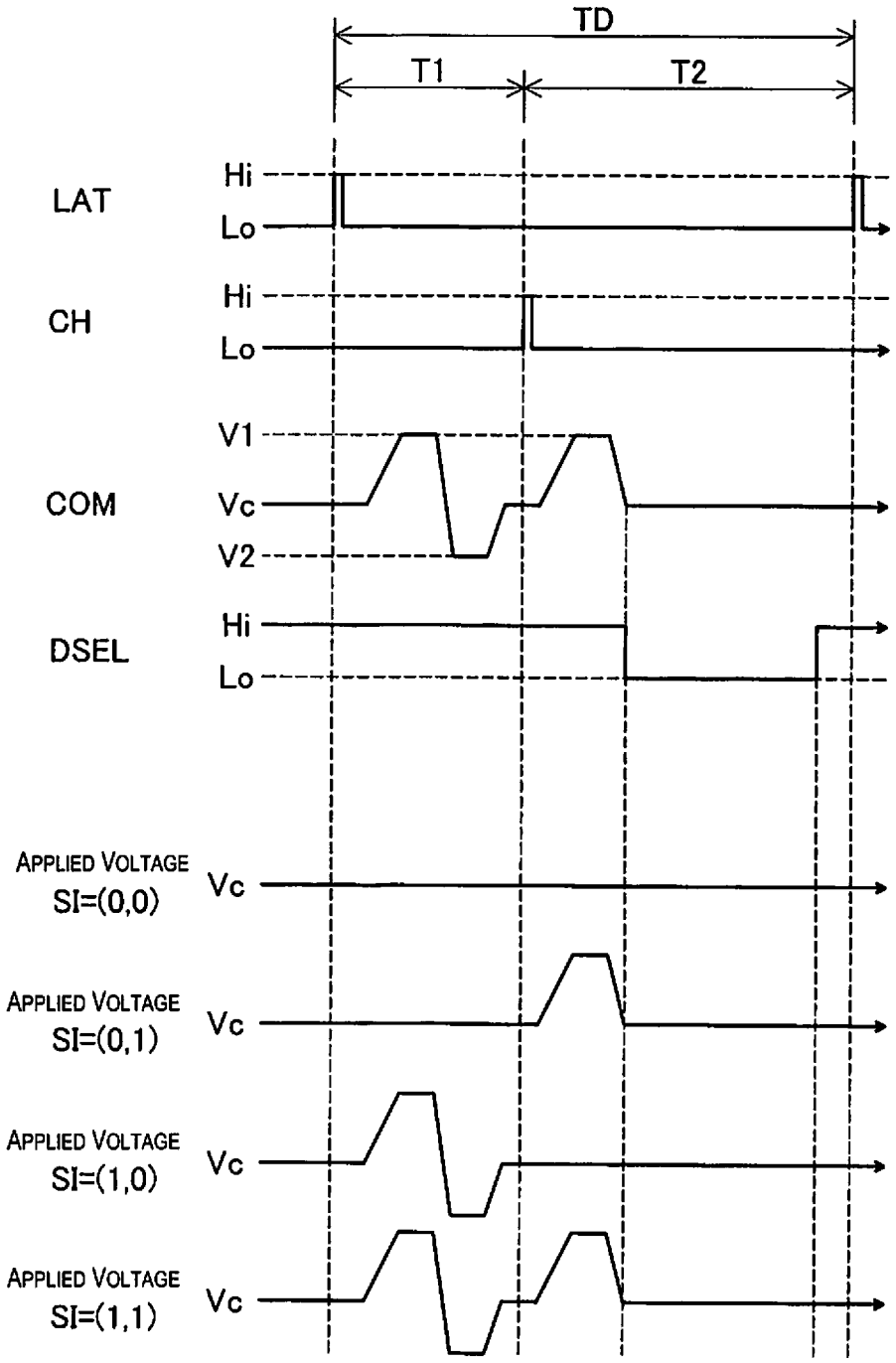
FIG. 5 is a descriptive drawing showing an example of various signals in the controller and head unit.

FIG. 5 is a descriptive drawing showing an example of various signals in the controller 100 and head unit 200. FIG. 5 shows the changes over time of, in order from the top, the latch signal LAT, the switching signal CH, the drive signal COM, and the detection operation signal DSEL; and at the bottom shows the changes over time in the voltage applied to a drive element 66 in response to the instruction data of the shift input signal SI.

The latch signal LAT is a logic signal which rises according to the drive cycle TD, and is inputted to the latch circuit 54 from the controller 100. The drive cycle TD is equivalent to a time period during which the drive element 66 in an ejection part 270 is driven to create one pixel on the print medium 90.

The switching signal CH is a signal generated in the head unit 200 on the basis of the latch signal LAT, and is a logic signal that rises according to the elapsing of a stipulated time duration following a rise in the latch signal LAT. During a first time period T1 from a rise in the latch signal LAT until a rise in the switching signal CH, the latch circuit 54 outputs a logic signal corresponding to the first bit in 2-bit instruction data received from the shift register 52, and during a second time period T2 from the rise in the switching signal CH until the next rise in the latch signal LAT, the latch circuit 54 outputs a logic signal corresponding to the second bit of the instruction data.

The drive signal COM is a voltage signal outputted periodically in synchronization with the drive cycle TD, and is supplied from the controller 100 to a drive element 66 through the shared electrical circuit 62 and a switch 64. During the first time period T1, the drive signal COM goes from being maintained at an intermediate voltage Vc to rising to a voltage V1 higher than the intermediate voltage Vc, and then falls to a voltage V2 lower than the intermediate voltage Vc and returns to the intermediate voltage Vc. Then, in the second time period T2, the drive signal COM rises from the intermediate voltage Vc to the voltage V1 higher than the intermediate voltage Vc, and then returns to being maintained at the intermediate voltage Vc. The drive signal COM during the first time period T1 is a signal of an application level at which ink droplets are ejected from the nozzle 48 of the ejection part 270. The drive signal COM during the second time period T2 is a signal of an application level at which residual vibration is created without ejecting ink droplets from the nozzle 48.

The detection operation signal DSEL is a logic signal which, when the ejection parts 270 are inspected based on residual vibration, falls from the timing at which the drive signal COM returns from the voltage V1 to the intermediate voltage Vc during the second time period T2 until a timing before the end of the second time period T2. When the detection operation signal DSEL falls, the switch 58 of the head unit 200 electrically blocks the shared electrical circuit 68 from ground, and the detection part 290 of the head unit 200 detects the electric signal HGND of the shared electrical circuit 68.

When the instruction data of the shift input signal SI is [0, 0], the voltage applied to the drive element 66 is maintained at the intermediate voltage Vc during the drive cycle TD. Ink droplets are thereby not ejected in the ejection part 270 corresponding to that drive element 66, and residual vibration does not occur. The instruction data [0, 0] of the shift input signal SI is designed for an ejection part 270 that does not form a pixel during printing or an ejection part 270 that will not be inspected based on residual vibration.

When the instruction data of the shift input signal SI is [0, 1], the voltage applied to the drive element 66 is maintained at the intermediate voltage Vc during the first time period T1, and the voltage then rises to the voltage V1 during the second time period T2. Residual vibration can thereby be generated without ejecting ink droplets in the ejection part 270 corresponding to that drive element 66. The instruction data [0, 1] of the shift input signal SI is designed for an ejection part 270 that will be inspected based on residual vibration when an inspection is conducted without forming a pixel.

When the instruction data of the shift input signal SI is [1, 0], the voltage applied to the drive element 66 changes to the voltage V1 and the voltage V2 during the first time period T1, and the voltage is maintained at the intermediate voltage Vc during the second time period T2. Ink droplets are thereby ejected in the ejection part 270 corresponding to that drive element 66. The instruction data [1, 0] of the shift input signal SI is designed for an ejection part 270 that forms a pixel during printing.

When the instruction data of the shift input signal SI is [1, 1], the voltage applied to the drive element 66 changes to the voltage V1 and the voltage V2 during the first time period T1, and then changes to the voltage V1 during the second time period T2. Residual vibration suitable for inspecting the ejection part 270 corresponding to that drive element 66 can thereby be generated while ink droplets are ejected in the ejection part 270. The instruction data [1, 1] of the shift input signal SI is designed for an ejection part 270 that will be inspected based on residual vibration when an inspection is conducted while forming a pixel.

Returning to the description of FIG. 4, the detection part 290 of the head unit 200 detects an electric signal SW corresponding to residual vibration of ink inside a cavity 46 of an ejection part 270, which is vibration remaining from the driving of the drive element 66. In the present example, the drive element 66 functions as a sensor for sensing residual vibration and outputting an electric signal SW corresponding to the residual vibration, and the electric signals SW outputted from the drive elements 66 are applied to the shared electrical circuit 68 by the electromotive force accompanying the residual vibration. The detection part 290 can thereby detect an electric signal corresponding to residual vibration by detecting the electric signal HGND of the shared electrical circuit 68. In the present example, the detection part 290 detects the electric signal HGND of the shared electrical circuit 68 on the basis of the detection operation signal DSEL outputted from the controller 100, and outputs to the controller 100 a detection signal POUT indicating a detection value of the residual vibration as a result of the detection.

The inspection part 102 of the controller 100 inspects the ejection part 270 on the basis of the electric signal detected by the detection part 290 of the head unit 200. In the present example, the inspection part 102 inspects clogging of the nozzle 48 (air bubbles in the ink or thickening of the ink) as the state of the ejection part 270 on the basis of the detection signal POUT outputted from the detection part 290 of the head unit 200.

Stored in advance in the reference storage part 104 of the controller 100 are determination reference data 120 indicating a determination reference of the inspection by the inspection part 102, and inspection print data 130 indicating the sequence of ejection parts 270 inspected by the inspection part 102. In the present example, the determination reference data 120 and the inspection print data 130 of the reference storage part 104 are created at the time of factory shipment of the printer 10, and are stored in the reference storage part 104.

The plurality of ejection parts 270 in the head 280 are classified into a number of ranks fewer than the total number of ejection parts 270 according to their residual vibration characteristics, and the determination reference data 120 of the reference storage part 104 includes a determination threshold for determining residual vibration in the ejection parts 270 for each of the ranks. The inspection print data 130 of the reference storage part 104 includes an inspection sequence such that of all the ejection parts 270, ejection parts 270 that are classified in the same rank are consecutive, and a shift input signal SI is outputted from the controller 100 to the head unit 200 on the basis of the inspection print data 130 when an ejection part 270 is inspected by the inspection part 102.

Figure 6:
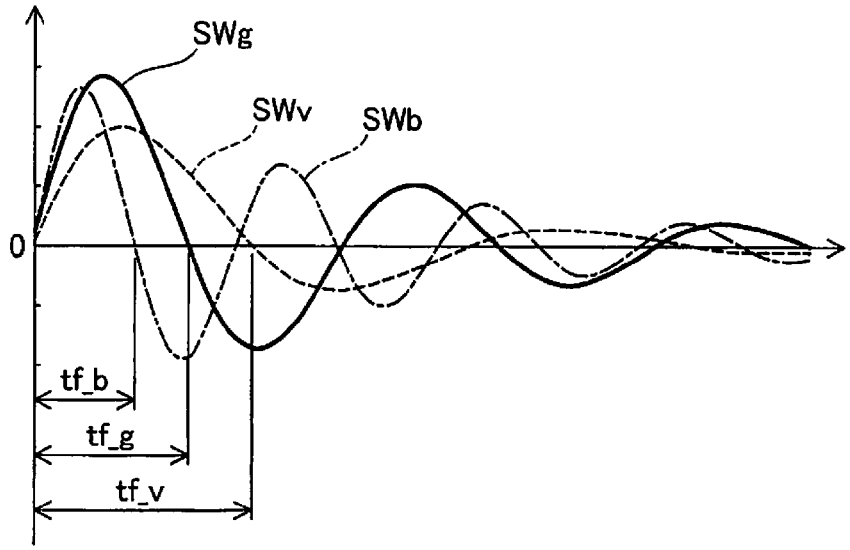
FIG. 6 is a descriptive drawing showing an example of changes in the electric signal corresponding to residual vibration.

FIG. 6 is a descriptive drawing showing an example of the changes in the electric signal SW corresponding to residual vibration. FIG. 6 shows electric signals SWg, SWb, and SWv, with voltage represented by the vertical axis and time represented on the horizontal axis. The electric signal SWg in FIG. 6 represents an electric signal SW corresponding to the residual vibration in a single ejection part 270 in a state capable of ejecting ink.

The following formula is obtained when step response is calculated for volume velocity u when pressure P is applied to a calculation model of simple harmonic vibration using the vibrating plate 67 in an ejection part 270.

[Formula 1]

$$u = \frac{P}{\omega \cdot m} e^{-\omega t} \cdot \sin\omega t \ (m^3/s) \tag{1a}$$

$$\omega = \sqrt{\frac{1}{m \cdot c} - \alpha^2} \tag{1b}$$

$$\alpha = \frac{r}{2m} \tag{1c}$$

In Formula 1 above, the flow passage resistance r depends on the shapes of the supply port 44, the cavity 46, the nozzles 48, and other flow passages as well as the viscosities of ink inside these flow passages; the intertance m depends on the quantity of ink inside the supply port 44, the cavity 46, the nozzles 48, and other flow passages; and the compliance c depends on the elasticity of the vibrating plate 67.

The electric signal SWb in FIG. 6 represents an electric signal SW corresponding to residual vibration in a single ejection part 270 that is unable to eject ink because of air bubbles in the ink inside the cavity 46. Since there is a small amount of ink in the cavity 46 when there are air bubbles in the ink in the cavity 46, primarily the intertance m is reduced. When the intertance m is reduced, the angular velocity ω increases as shown in the previously described Formula 1. Therefore, the oscillation cycle of the electric signal SWb is shorter than that of the electric signal SWg, and the time tf_b indicating the first half-cycle of the electric signal SWb is shorter than the time tf_g indicating the first half-cycle of the electric signal SWg, as shown in FIG. 6.

The electric signal SWv in FIG. 6 represents an electric signal SW corresponding to residual vibration in a single ejection part 270 that cannot eject ink because the ink in the cavity 46 has thickened. When the ink in the cavity 46 thickens, the flow passage resistance r increases. When the flow passage resistance r increases, the angular velocity co decreases as shown in the previously described Formula 1. Therefore, the oscillation cycle of the electric signal SWv is longer than that of the electric signal SWg, and the time tf_v indicating the first half-cycle of the electric signal SWb is longer than the time tf_g indicating the first half-cycle of the electric signal SWg, as shown in FIG. 6.

Figure 7:
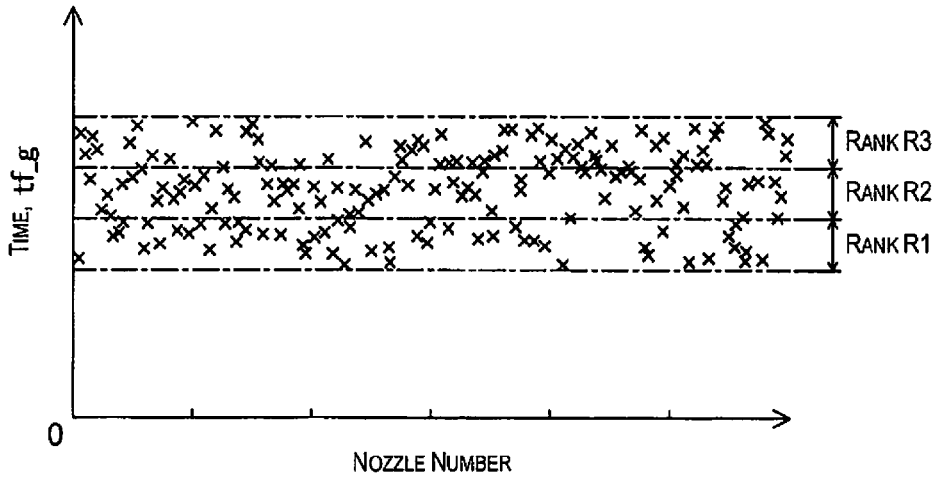
FIG. 7 is a descriptive drawing showing an example of the ranking of the ejection parts based on the residual vibration cycle.

FIG. 7 is a descriptive drawing showing an example of the ranking of the ejection parts 270 based on the residual vibration cycle. In FIG. 7, the vertical axis represents time, the horizontal axis represents the nozzle number, and the time tf_g representing the first half-cycle in the residual vibration is depicted as the detection values of residual vibration detected in ejection parts 270 that are unable to eject ink. The time tf_g shown in FIG. 7 pertains to n ejection parts 270 that eject ink of the same color among all of the ejection parts 270 in the head 280.

There time tf_g has variations resulting from the positional relationships of the ejection parts 270, manufacturing errors, and other causes, as shown in FIG. 7. In the present example, the plurality of ejection parts 270 in the head 280 are classified into three ranks R1, R2, and R3 according to the distribution of the time tf_g for each ink color. In the present example, the distribution width of the time tf_g is the same for each of the ranks, and the time tf_g increases in order of rank R1, R2, and R3.

Figure 8:
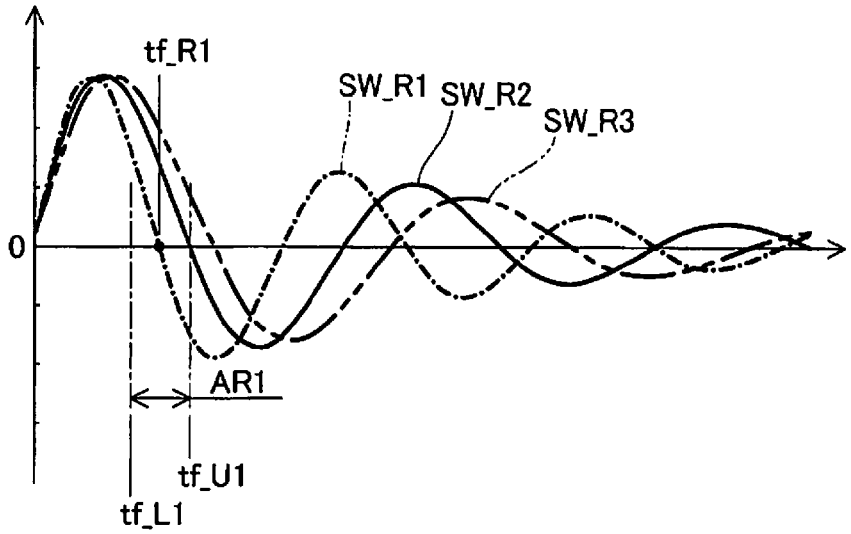
FIG. 8 is a descriptive drawing showing an example of determination thresholds based on the residual vibration cycle.
Figure 9:
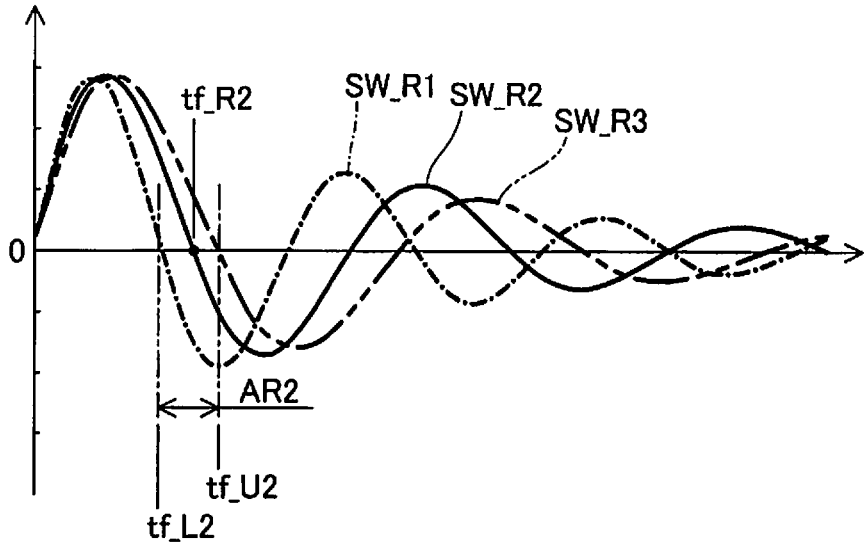
FIG. 9 is a descriptive drawing showing an example of determination thresholds based on the residual vibration cycle.
Figure 10:
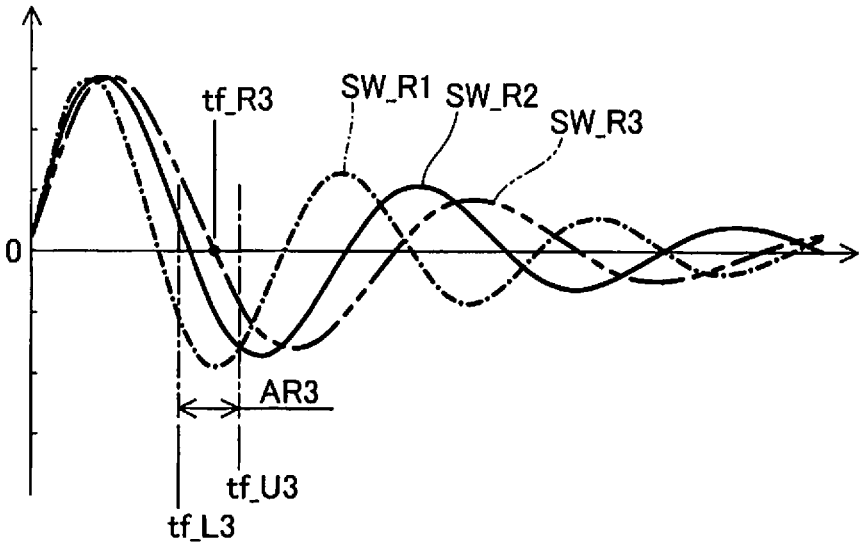
FIG. 10 is a descriptive drawing showing an example of determination thresholds based on the residual vibration cycle.

FIGS. 8 through 10 are descriptive drawings showing examples of the determination thresholds based on the residual vibration cycle. In FIGS. 8 through 10, the vertical axis represents voltage, the horizontal axis represents time, and as typical electric signals SWg for each of the ranks, an electric signal SWg_R1 is shown for rank R1, an electric signal SWg_R2 is shown for rank R2, and an electric signal SWg_R3 is shown for rank R3.

FIG. 8 shows a lower limit threshold tf_L1 and an upper limit threshold tf_U1 as determination thresholds for inspecting ejection parts 270 classified in rank R1. When a time tf_R1, which indicates the first half-cycle of residual vibrations detected in the ejection parts 270 of rank R1, is within an acceptable range AR1 from the lower limit threshold tf_L1 to the upper limit threshold tf_U1, those ejection parts 270 are determined to be in a state capable of ejecting ink, and when the time tf_R1 is not within the acceptable range AR1, the ejection parts are determined to be in a state incapable of ejecting ink due to clogging of the nozzles 48.

FIG. 9 shows a lower limit threshold tf_L2 and an upper limit threshold tf_U2 as determination thresholds for inspecting ejection parts 270 classified in rank R2. When a time t_R2, which indicates the first half-cycle of residual vibrations detected in the ejection parts 270 of rank R2, is within an acceptable range AR2 from the lower limit threshold tf_L2 to the upper limit threshold tf_U2, those ejection parts 270 are determined to be in a state capable of ejecting ink, and when the time tf_R2 is not within the acceptable range AR2, the ejection parts are determined to be in a state incapable of ejecting ink due to clogging of the nozzles 48.

FIG. 10 shows a lower limit threshold tf_L3 and an upper limit threshold tf_U3 as determination thresholds for inspecting ejection parts 270 classified in rank R3. When a time tf_R3, which indicates the first half-cycle of residual vibrations detected in the ejection parts 270 of rank R3, is within an acceptable range AR3 from the lower limit threshold tf_L3 to the upper limit threshold tf_U3, those ejection parts 270 are determined to be in a state capable of ejecting ink, and when the time tf_R3 is not within the acceptable range AR3, the ejection parts are determined to be in a state incapable of ejecting ink due to clogging of the nozzles 48.

Figure 11:
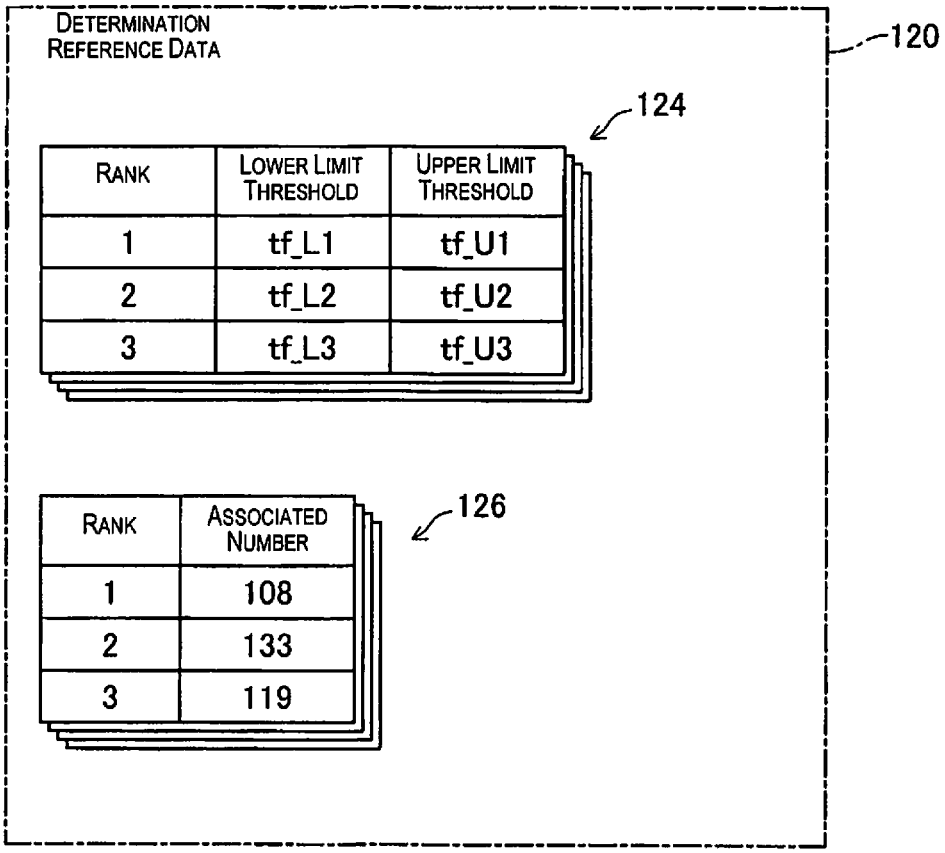
FIG. 11 is a descriptive drawing showing an example of determination reference data.

FIG. 11 is a descriptive drawing showing an example of the determination reference data 120. The determination reference data 120 includes threshold information 124 indicating the determination threshold for each of the ranks, and associated number information 126 indicating the number of ejection parts 270 associated with each of the ranks. In the present example, the determination reference data 120 includes threshold information 124 and associated number information 126 prepared for each color of ink.

In the present example, the plurality of ejection parts 270 in the head 280 are classified into the three ranks R1, R2, and R3 shown in FIG. 7, and the threshold information 124 of the determination reference data 120 includes the lower limit thresholds tf_L1 to 3 and the upper limit thresholds tf_U1 to 3 shown in FIGS. 8 through 10, the thresholds set for each of the ranks as determination thresholds for determining the cycle of residual vibration in the ejection parts 270. In the present example, 360 ejection parts 270 are provided for each color of ink in the head 280, and the associated number information 126 of the determination reference data 120 indicates that 108 ejection parts 270 are associated with rank R1, 133 are associated with rank R2, and 119 are associated with rank R3.

FIG. 12 is a descriptive drawing showing an example of the inspection print data 130. The inspection print data 130 includes print information 132 indicating the sequence of ejection parts 270 inspected by the inspection part 102. The print information 132 of the inspection print data 130 indicates the inspection sequence of ejection parts 270 so that ejection parts 270 associated with the same rank are consecutive.

In the example shown in FIG. 12, the print information 132 shows that after the 108 ejection parts 270 associated with rank R1 have been consecutively inspected in first through $108^{th}$ inspections, the 133 ejection parts 270 associated with rank R2 are consecutively inspected in the $109^{th}$ through $241^{st}$ inspections, and the 126 ejection parts 270 associated with rank R3 are then consecutively inspected in the $242^{nd}$ through $360^{th}$ inspections. In the present example, the inspection sequence of each of the ranks is a sequence according to nozzle number, but other embodiments can use a sequence in which adjacent ejection parts 270 are not driven consecutively.

A2. Actions of Printer

Figure 13:
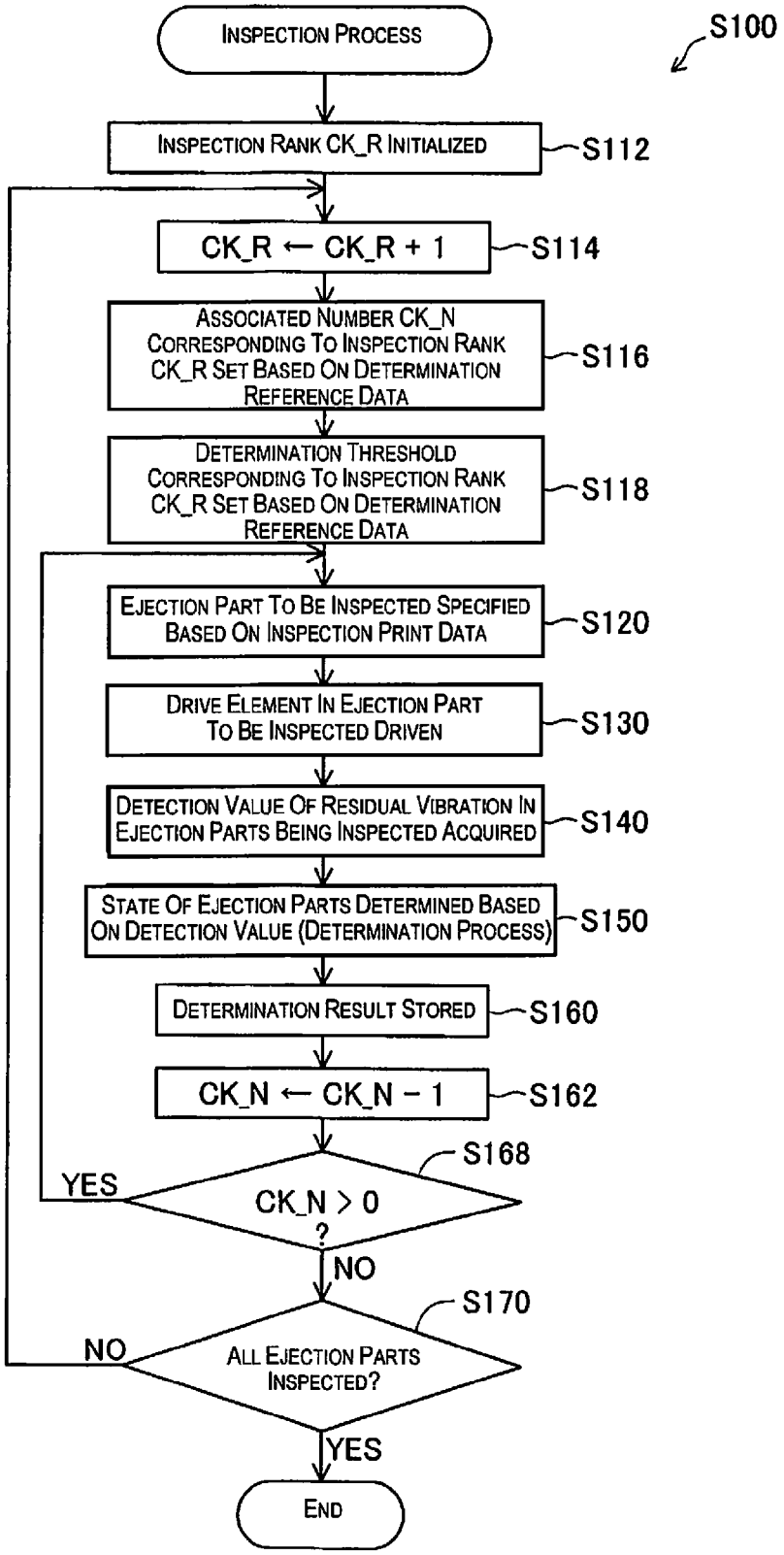
FIG. 13 is a flowchart showing the inspection process performed by the controller in the printer.

FIG. 13 is a flowchart showing the inspection process (step S100) performed by the controller 100 in the printer 10. The inspection process (step S100) is a process for inspecting the plurality of ejection parts 270 in the head unit 200 on the basis of residual vibration.

In the present example, the controller 100 performs the inspection process (step S100) for each groups of ejection parts 270 that ejects ink of the same color (the same type of liquid). For example, after performing the inspection process (step S100) on the black ejection parts 270, the controller 100 then performs the inspection process (step S100) in order on the cyan ejection parts 270, the magenta ejection parts 270, and the yellow ejection parts 270.

In the present example, the inspection process (step S100) is performed by the CPU of the controller 100 operating as the inspection part 102 on the basis of a computer program. In the present example, the controller 100 starts the inspection process (step S100) on the basis of a preset time point or a command input from the user.

When the inspection process (step S100) is started, the controller 100 initializes an inspection rank CK_R which is a control variable (step S112). In the present example, the controller 100 sets the inspection rank CK_R to "0."

After the inspection rank CK_R has been initialized (step S112), the controller 100 increments inspection ranks CK_R (step S114), and sets associated numbers CK_N corresponding to the inspection ranks CK_R (step S116) on the basis of the determination reference data 120 of the reference storage part 104. In the present example, based on the associated number information 126 of the determination reference data 120 shown in FIG. 11, the controller 100 sets the associated number CK_N to "108" when the inspection rank CK_R is "1," the associated number CK_N to "133" when the inspection rank CK_R is "2," and the associated number CK_N to "119" when the inspection rank CK_R is "3."

After the associated number CK_N has been set (step S116), the controller 100 sets determination thresholds corresponding to inspection rank CK_R on the basis of the determination reference data 120 of the reference storage part 104 (step S118). In the present example, the controller 100 sets a lower limit threshold tf_L and an upper limit threshold tf_U corresponding to each inspection rank CK_R as determination thresholds on the basis of the threshold information 124 of the determination reference data 120 shown in FIG. 11.

After the determination threshold has been set (step S118), based on the inspection print data 130 of the reference storage part 104, the controller 100 specifies the ejection parts 270 being inspected (step S120) and drives the drive elements 66 in the ejection parts 270 being inspected (step S130).

Specifically, based on the print information 132 of the inspection print data 130, the parameters [0, 1] are set for the command data of the shift input signal SI corresponding to the ejection parts 270 being inspected, the parameters [0, 0] are set for the command data of the shift input signal SI corresponding to other ejection parts 270, and a latch signal LAT, a drive signal COM, and a detection operation signal DSEL are outputted together with the shift input signal SI and a clock signal SCK to the head unit 200 as shown in FIG. 5. An electric signal SW corresponding to residual vibration is thereby applied to the shared electrical circuit 68 from the drive elements 66 in the ejection parts 270 being inspected. At this time, the electric signal HGND of the shared electrical circuit 68 detected by the detection part 290 of the head unit 200 is the electric signal SW corresponding to residual vibration in the ejection parts 270 being inspected, and the detection part 290 outputs to the controller 100 a detection signal POUT indicating the detection value of the electric signal SW as the detection result.

After the drive elements 66 being inspected have been driven (step S130), the controller 100 acquired the electric signal SW (step S140) through the detection signal POUT outputted from the detection part 290 of the head unit 200. In the present example, the controller 100 acquires a time duration tf indicating the first half-cycle in the electric signal SW as a detection value of the electric signal SW corresponding to residual vibration.

After the detection value of residual vibration is acquired (step S140), the controller 100 performs a determination process (step S150). In the determination process (step S150), the controller 100 determines whether or not there is clogging of the nozzles 48 (air bubbles in the ink and thickening of the ink) as the state of the ejection parts 270 being inspected, based on the electric signal SW detected by the detection part 290 of the head unit 200.

Specifically, the controller 100 compares the time duration tf acquired as a detection value of residual vibration with the acceptable range AR from the lower limit threshold tf_L to the upper limit threshold tf_U set as the determination threshold on the basis of the determination reference data 120. When the time duration tf is within the acceptable range AR, the controller 100 determines that the ejection parts 270 being inspected are in a state capable of ejecting ink (in a state of no clogging). When the time duration tf is below the lower limit threshold tf_L, the controller 100 determines a state incapable of ejecting ink (a state of clogging by air bubbles) due to the presence of air bubbles in the ink, and when the time duration tf is above the upper limit threshold tf_U, the controller 100 determines a state incapable of ejecting ink (a state of clogging by thickening) due to the ink having thickened.

After the determination process (step S150), the controller 100 stores the determination result (step S160) of the determination process (step S150) and decrements the associated number CK_N (step S162). The controller 100 then repeatedly performs the process starting with specifying the ejection parts 270 being inspected (step S120) until the associated number CK_N reaches 0, i.e., until all of the ejection parts 270 associated with the rank indicated by the inspection rank CK_R have been inspected (step S168: "YES").

When all of the ejection parts 270 associated with the rank indicated by the inspection rank CK_R have been inspected (step S168: "NO"), the controller 100 repeatedly performs the process (step S170: "NO") starting with incrementing the inspection rank CK_R (step S114) until the inspections of all the ranks are completed. When the inspections of all the ejection parts 270 in the head 280 are completed (step S170: "YES"), the controller 100 ends the inspection process (step S100). In the present example, according to the inspection results of the inspection process (step S100), the controller 100 performs a process of maintenance on the head unit 200 using the head cap 340.

A3. Ranking

Figure 14:
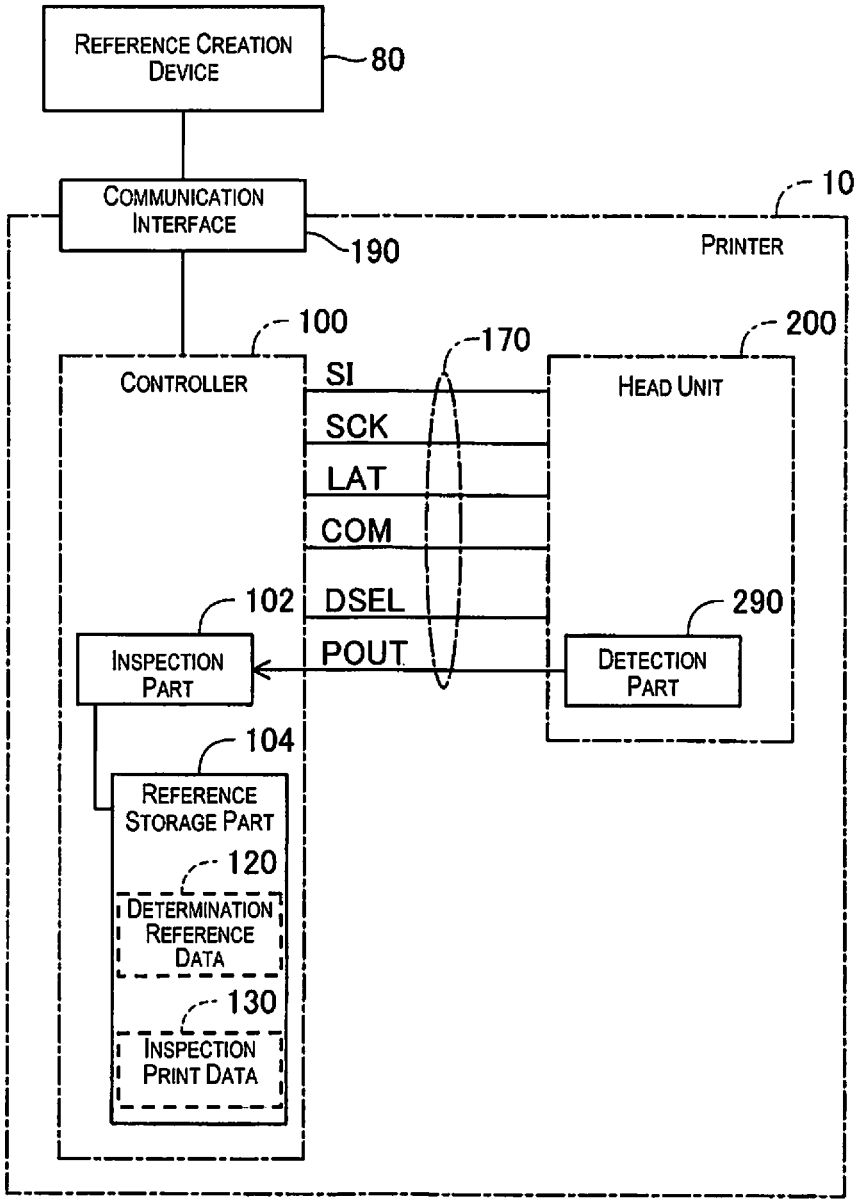
FIG. 14 is a descriptive drawing showing the printer and a reference creation device.

FIG. 14 is a descriptive drawing showing the printer 10 and a reference creation device 80. The reference creation device 80 is a device for creating determination reference data 120 and inspection print data 130 at the time of factory shipment of the printer 10, and writing the determination reference data 120 and inspection print data 130 into the reference storage part 104 of the printer 10.

In the present example, the reference creation device 80 is a computer including CPU, ROM, RAM, an input/output interface, and the like; and capable of being electrically connected with the printer 10 through the communication interface 190. The various functions of the reference creation device 80 are performed by the CPU operating based on a computer program, but in other embodiments, at least some of the functions of the reference creation device 80 can be performed by an electrical circuit, which is provided to the reference creation device 80, operating based on the circuit configuration thereof.

Figure 15:
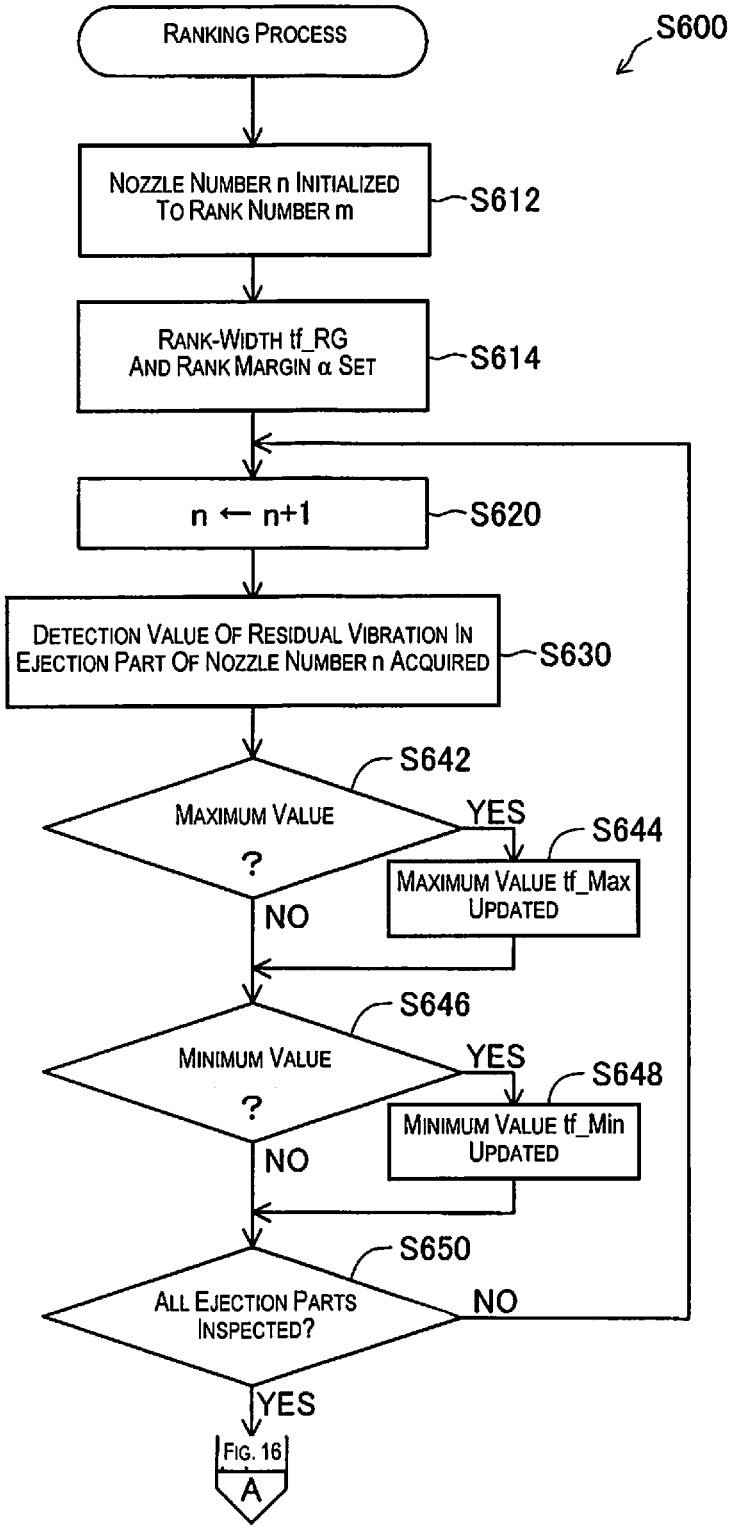
FIG. 15 is a flowchart showing the ranking process performed by the reference creation device.
Figure 16:
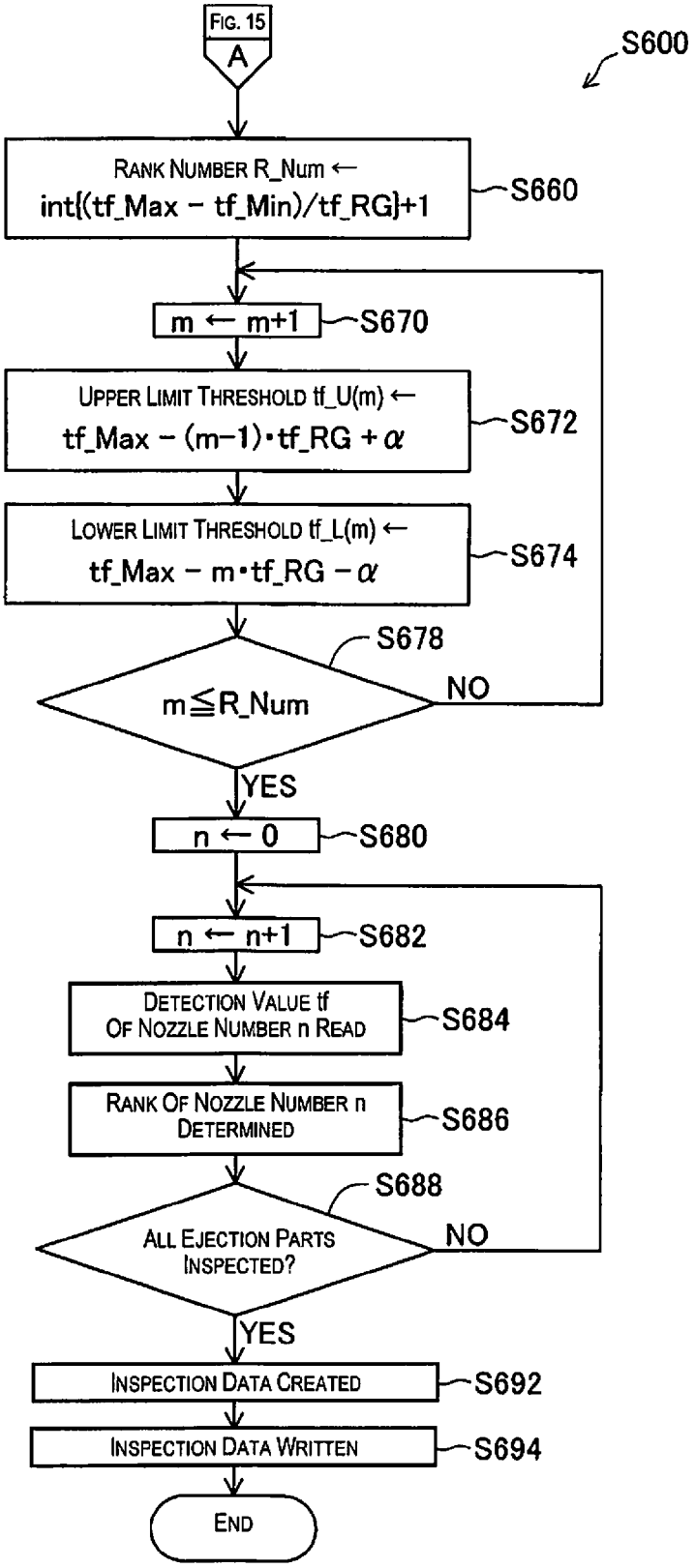
FIG. 16 is a flowchart showing the ranking process performed by the reference creation device.

FIGS. 15 and 16 are flowcharts showing the ranking process (step S600) performed by the reference creation device 80. The ranking process (step S600 is a process for creating determination reference data 120 and inspection print data 130 based on the ranking shown in FIG. 7, and writing the determination reference data 120 and inspection print data 130 into the reference storage part 104 of the printer 10. In the present example, the ranking process (step S600) is performed by the reference creation device 80 operating based on a computer program. In the present example, after the reference creation device 80 has been connected by the operator handling the reference creation device 80 to a printer 10 that is awaiting factory shipment, in which all the ejection parts 270 of the head 280 are confirmed to be capable of ejecting ink, the reference creation device 80 starts the ranking process (step S600) on the basis of a command input from the operator.

When the ranking process (step S600) is started, the reference creation device 80 initializes a nozzle number n and a rank number m, which are control variables (step S612). In the present example, the reference creation device 80 sets the nozzle number n and the rank number m to "0."

After the nozzle number n and the rank number m have been initialized, the reference creation device 80 sets a rank-width tf_RG and a rank margin $\alpha$ (step S614). The rank-width tf_RG is a value expressing the width of the rank of each stage in terms of the width of a time tf_g, and the rank margin $\alpha$ is a value expressing the margin of the time tf_g for calculating the lower limit threshold tf_L and upper limit threshold tf_U which are determination thresholds. In the present example, the rank-width tf_RG and the rank margin $\alpha$ are values stipulated in advance by the designer of the printer 10.

After the rank-width tf_RG and the rank margin $\alpha$ have been set (step S614), the reference creation device 80 increments the nozzle number n (step S620) and acquires a detection value of residual vibration in the ejection part 270 of the nozzle number n (S630), whereby detection values of residual vibration in all of the ejection parts 270 are acquired (step S650). Specifically, the reference creation device 80 indicates a nozzle number n and requests a detection value of residual vibration from the printer 10. In compliance with this request, the printer 10 drives the ejection part 270 corresponding to the nozzle number n to detect residual vibration similar to the inspection process (step S100), and then provides a detection value of residual vibration as the detection result to the reference creation device 80. In the present example, the reference creation device 80 acquires a time tf_g indicating the first half-cycle in the electric signal SW_g corresponding to the residual vibration as a detection value of residual vibration.

Along with acquiring the time tf_g as a detection value of residual vibration (step S630), the reference creation device 80 sets a maximum detection value as a maximum value tf_Max (step S642: "YES," S644), and sets a minimum detection value as a minimum value tf_Min (step S646: "YES," S648).

Moving on to a description of FIG. 16, after detection values for all the ejection parts 270 have been acquired (step S650: "YES"), the reference creation device 80, based on the maximum value tf_Max, the minimum value tf_Min, and the rank-width tf_RG, the reference creation device 80 calculates a rank number R_Num (step S660), which is the number of ranks for classifying the plurality of ejection parts 270.

After the rank number R_Num has been calculated (step S660), based on the maximum value tf_Max, the rank-width tf_RG, and the rank margin α, the reference creation device 80 calculates the upper limit threshold tf_U and the lower limit threshold tf_L for each of the ranks (steps S670, S672, S674, S678). In the present example, the ranks for classifying the plurality of ejection parts 270 are set within the range of the time tf_g including the rank-width tf_RG in order from the maximum value tf_Max.

After the upper limit threshold tf_U and the lower limit threshold tf_L have been calculated for each of the ranks (step S658: "YES"), the reference creation device 80 ranks the ejection parts 270 by determining which of the plurality of ranks the times tf_g of the ejection parts 270 are associated with, the times tf_g of the ejection parts 270 having been acquired from the printer 10 and the ranks being the ranges of the time tf_g including the rank-width tf_RG in order from the maximum value tf_Max (steps S682, S684, S686, S688).

After all the ejection parts 270 have been ranked (step S688: "YES"), the reference creation device 80 creates determination reference data 120 and inspection print data 130 (step S692) on the basis of the ranking results and the upper limit thresholds tf_U and lower limit thresholds tf_L calculated for each of the ranks. After the determination reference data 120 and inspection print data 130 have been created (step S692, the reference creation device 80 writes the determination reference data 120 and inspection print data 130 into the reference storage part 104 of the controller 100 in the printer 10 (step S694) and ends the ranking process (step S600).

A4. Results

According to the printer 10 of the first example described above, the plurality of ejection parts 270 in the head 280 are classified into a plurality of ranks R1, R2, R3 in accordance with the distribution area of the time tf_g indicating the first half-cycle in residual vibration while in a state capable of ejecting ink, and a determination reference is set in the determination reference data 120 for each of the ranks; therefore, it is possible to prevent erroneous determinations in the inspection resulting from excessive expansion of the acceptable range. Since ejection parts 270 of the same rank are inspected consecutively based on the inspection print data 130, frequent switching of the determination reference in the inspection process (step S100) can be avoided, and the increase in processing load from using a determination reference corresponding to rank can be suppressed.

Since the plurality of ejection parts 270 are classified in the plurality of ranks R1, R2, R3 according to the time tf_g pertaining to the residual vibration cycle and the determination threshold in the threshold information 124 of the determination reference data 120 is the time tf_g pertaining to the residual vibration cycle, each of the ranks can be inspected easily. Since a reference storage part 104 for storing the determination reference data 120 in advance is provided, inspection can be performed based on a determination reference prepared in advance.

B. Second Example

The printer 10 of the second example is similar to the first example except for differences in the determination reference data 120 and inspection print data 130 stored in advance in the reference storage part 104 and a difference in the inspection process (step S100).

Figure 17:
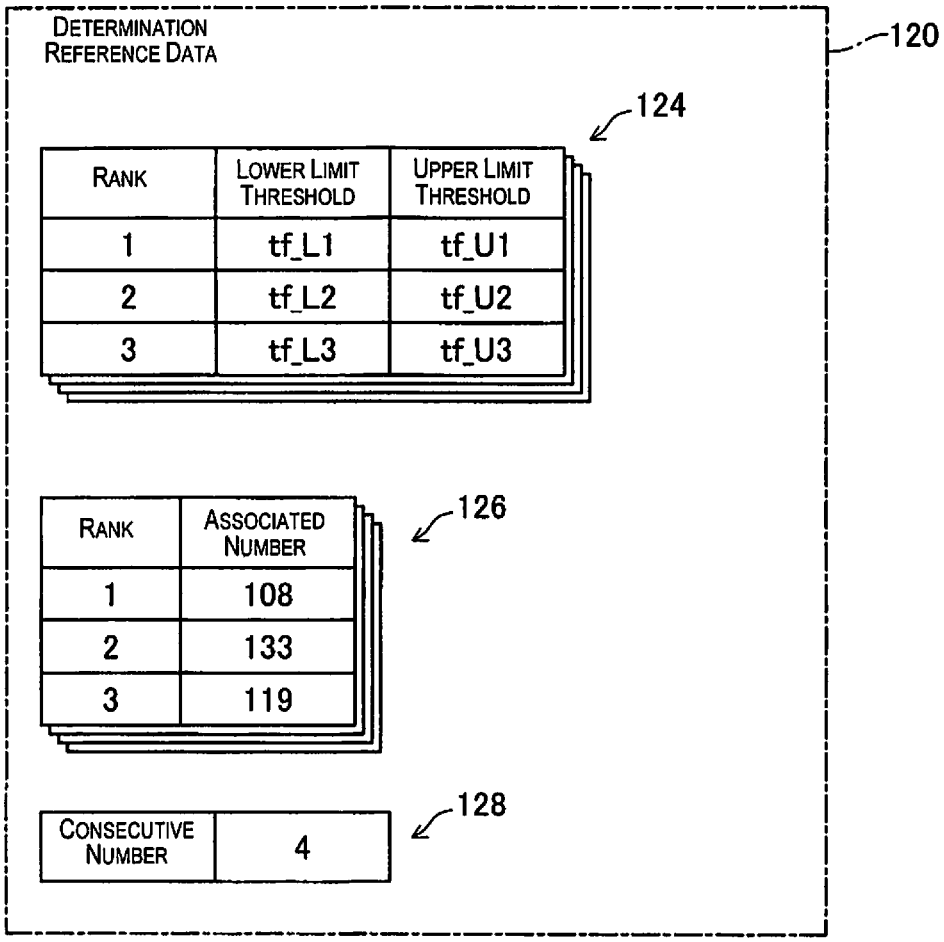
FIG. 17 is a descriptive drawing showing an example of determination reference data in the second example.

FIG. 17 is a descriptive drawing showing an example of the determination reference data 120 in the second example. In addition to the threshold information 124 and the associated number information 126, the determination reference data 120 of the second example includes consecutive number information 128 indicating the number of consecutive ejection parts 270 of the same rank in the inspection sequence of the inspection print data 130. In the present example, the threshold information 124 and the associated number information 126 of the determination reference data 120 in the second example are similar to those of the first example, and the consecutive number information 128 of the determination reference data 120 in the second example indicates that there are four ejection parts 270 of the same rank that are consecutive in the inspection sequence of the inspection print data 130.

FIG. 18 is a descriptive drawing showing an example of inspection print data 130 in the second example. The print information 132 of the inspection print data 130 of the second example indicates an inspection sequence of ejection parts 270 so that a predetermined number of ejection parts 270 are consecutive in each of the ranks.

In the example shown in FIG. 18, four ejection parts 270 are inspected consecutively for each of the ranks R1, R2, R3, and when the fourth inspection in rank R3 ends, another four ejection parts 270 are inspected consecutively for each of the ranks R1, R2, R3. Since the present example is not limited to having the same number of ejection parts 270 associated with each of the ranks, when all of the inspections are ended for ranks having a small number of associated ejection parts 270, four ejection parts 270 are consecutively inspected for each of the remaining ranks. In the present example, the consecutive number of each of the ranks is four but is not limited as such, and can be two or more.

The inspection process (step S100) of the second example is similar to that of the first example, except that the determination threshold indicated in the threshold information 124 of the determination reference data 120 is switched to match the alignment of rank indicated in the print information 132 of the inspection print data 130, on the basis of the associated number of each of the ranks indicated in the associated number information 126 of the determination reference data 120 and the consecutive number indicated in the consecutive number information 128 of the determination reference data 120.

According to the printer 10 of the second example described above, similar to the first example, the plurality of ejection parts 270 in the head 280 are classified into a plurality of ranks R1, R2, R3 in accordance with the distribution area of the time tf_g indicating the first half-cycle in residual vibration while in a state capable of ejecting ink, and a determination reference is set in the determination reference data 120 for each of the ranks; therefore, it is possible to prevent erroneous determinations in the inspection resulting from excessive expansion of the acceptable range. Since a predetermined number of ejection parts 270 in each of the ranks are inspected consecutively based on the inspection print data 130, frequent switching of the determination reference in the inspection process (step S100) can be avoided, the increase in processing load from using a determination reference corresponding to rank can be suppressed, and the ejection parts 270 of all ranks can be inspected uniformly.

C. Third Example

Figure 19:
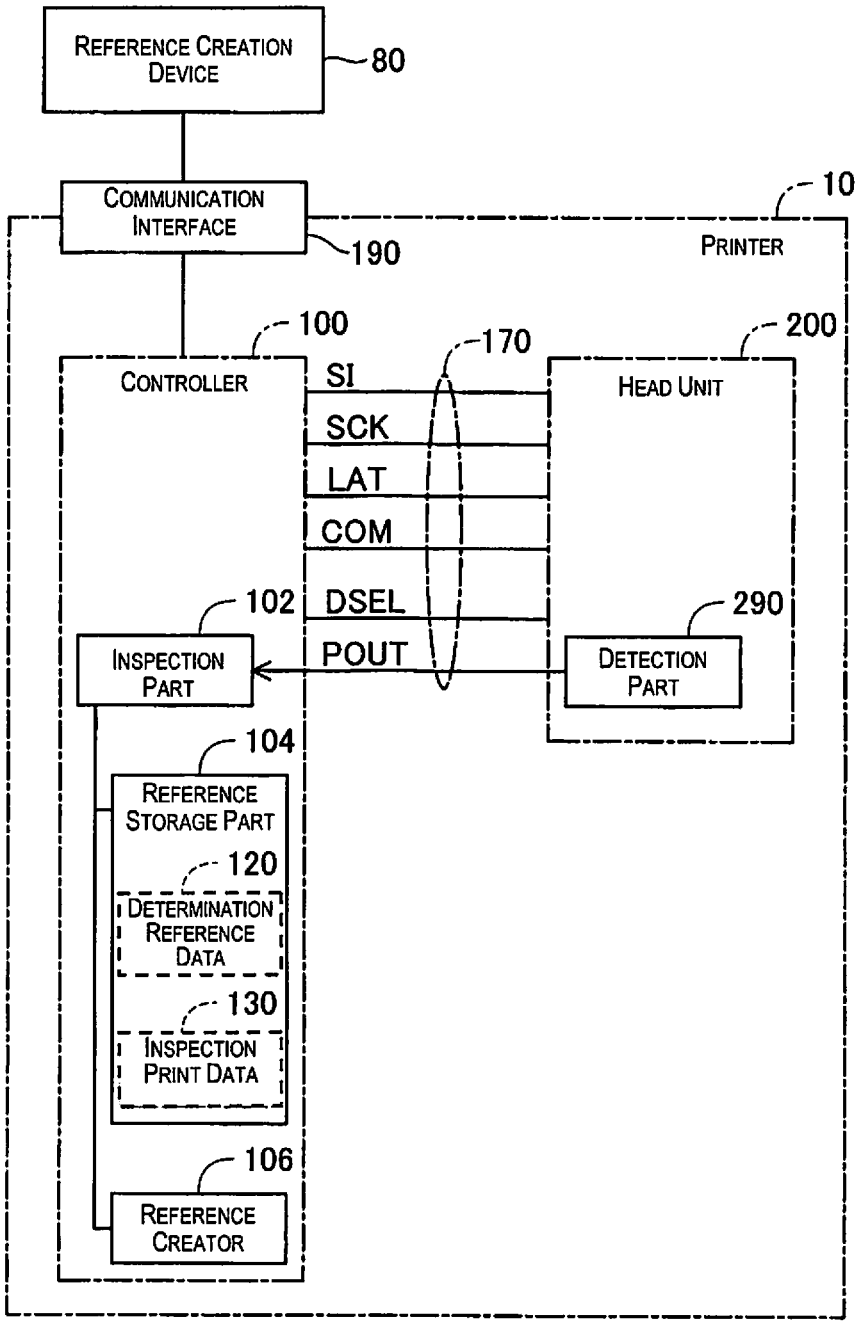
FIG. 19 is a descriptive drawing showing a printer of the third example.

FIG. 19 is a descriptive drawing showing the printer 10 of the third example. The printer 10 of the third example is similar to that of the first example except for having a reference creator 106.

The reference creator 106 of the printer 10 creates determination reference data 120 and inspection print data 130 in accordance with the residual vibration characteristics in each of the plurality of ejection parts 270. In the present example, the determination reference data 120 and inspection print data 130 in the reference storage part 104 are stored in advance at the time of factory shipment of the printer 10, but when the cumulative operating time of the printer 10 exceeds a predetermined value or when the head 280 is replaced, the reference creator 106 creates new determination reference data 120 and inspection print data 130 and updates the determination reference data 120 and inspection print data 130 of the reference storage part 104.

In the present example, the reference creator 106 creates determination reference data 120 and inspection print data 130 in the same manner as the ranking process (step S600) by the reference creation device 80 of the first example, but in other embodiments, the determination reference data 120 and the inspection print data 130 can be created with a different reference from that of the reference creation device 80. In the present example, the function of the reference creator 106 is performed by the CPU of the controller 100 operating based on a computer program.

According to the printer 10 of the third example, similar to the first example, it is possible to prevent erroneous determinations in the inspection resulting from excessive expansion of the acceptable range, and to suppress increases in the processing load caused by using a determination reference corresponding to rank. Since the determination reference data 120 and the inspection print data 130 are created by the reference creator 106, the determination reference and inspection sequence can be updated according to the changes in residual vibration characteristics in the plurality of ejection parts 270.

D. Other Embodiments

Embodiments of the invention were described above, but the invention is not limited to such embodiments, and the invention can of course be carried out in various forms within a range that does not deviate from the scope of the invention.

For example, in the examples described above, drive elements 66 were used as sensors for sensing residual vibration in the ejection parts 270, but in other embodiments, designated sensors for sensing residual vibration can be used apart from the drive elements 66.

In the examples described above, residual vibration is detected by driving the drive elements 66 at an application level that induces residual vibration without ejecting ink droplets, but in other embodiments, residual vibration can be detected by driving the drive elements 66 at an application level that cases ink droplets to be ejected.

In the examples described above, the inspection process (step S100) is performed at a different timing than printing on the print medium 90, but in other embodiments, the ejection parts 270 can be inspected based on an electric signal SW corresponding to residual vibration during printing on the print medium 90.

In the examples described above, the inspection process (step S100) is performed based on the time duration tf indicating the first half-cycle in residual vibration, but in other embodiments, a determination threshold used in the determination in at least one residual vibration characteristic including the cycle, the phase, and the amplitude can be set in the determination reference data 120 in advance, and the inspection process (step S100) can be performed based on at least one residual vibration characteristic including the cycle, the phase, and the amplitude.

In the examples described above, the signal level of the drive signal for driving the drive elements in the ejection parts 270 is one voltage V1, but in other embodiments, a determination reference corresponding to the signal level (e.g., voltage, electric current, amount of electricity, etc.) of the drive signal can also be set in the determination reference data 120 for each of the ranks, and the inspection process (step S100) can be performed according to the signal level of the drive signal. It is thereby possible to better prevent erroneous determinations in the inspection based on residual vibration while taking into account the residual vibration characteristics which change according to the signal level of the drive signal.

In the examples described above, the plurality of ejection parts 270 are ranked based on the time duration tf indicating the first half-cycle in residual vibration, but in other embodiments, the ejection parts can be ranked according to at least one of the residual vibration characteristics including repeatability, cycle, phase, and amplitude.

The number of ranks into which the plurality of ejection parts 270 are ranked can be appropriately set to a number that is two or more and less than the total number of ejection parts 270.

In the examples described above, an inkjet printer for ejecting in was described as an example of a liquid ejection device, but the liquid ejected by the liquid ejection device of the invention is not limited to ink, and can be various other liquids, or fluids containing a solid dispersed in a liquid or gas. For example, the invention is not limited to an inkjet type of printer, and can also be applied to other types of printers. The invention can be applied to ejection devices that are used in the manufacture of liquid crystal displayed, organic EL (Electro Luminescence) displays, surface emission displays (Field Emission Displays, FEDs), and the like; and that eject a liquid substance containing an electrode material, a coloring material, or another material in a dispersed or dissolved state. The invention can also be applied to ejection devices that are used in the manufacture of biochips and that eject a liquid substance containing a bioorganic substance. The invention can also be applied to ejection devices that are used as precision pipettes and that eject a liquid substance as a test sample.

The invention can also be applied to ejection devices for ejecting lubricating oil at pinpoints onto watches, cameras, and other precision instruments; and ejection devices for ejecting an ultraviolet curing resin or another transparent resin liquid in order to form a microscopic semispherical lens (optical lens) used in an optical communication element. The invention can also be applied to ejection devices for ejecting an etching liquid for etching a wafer, or ejection devices for ejecting a toner or another powder.

What is claimed is:

1. An inspection method for inspecting a plurality of ejection parts for ejecting liquid in cavities from nozzles communicated with the cavities, the liquid being ejected by the driving of a drive element, the inspection method comprising:

a detection step for detecting the state of the liquid in the cavities; and an inspection step for inspecting the ejection parts on the basis of a detection value from the detection step, wherein the ejection parts are classified into a plurality of ranks for inspection according to the characteristics of individual ejection parts, each rank being configured to classify the ejection parts based on a predetermined reference.

2. The inspection method according to claim 1, wherein the inspection step is performed based on the detection value in accordance with a determination reference corresponding to the ranks, and the inspection step is performed consecutively on those among the plurality of ejection parts that are classified in the same rank.

3. The inspection method device according to claim 2, wherein the inspection step is performed consecutively on a predetermined number of the ejection parts for each of the ranks.

4. The liquid ejection device according to claim 1, wherein the state of the liquid in the cavities corresponds to residual vibration, which is vibration of the liquid in the cavities and which persists due to the driving of the drive elements.

5. The inspection method according to claim 4, wherein the characteristics are residual vibration characteristics in each of the ejection parts.

6. A non-transitory computer-readable storage medium having stored thereon a program for causing a computer to run a function for inspecting a plurality of ejection parts for ejecting liquid in cavities from nozzles communicated with the cavities, the liquid being ejected by the driving of a drive element, the program runs:

a detection function for detecting the state of the liquid in the cavities; and an inspection function for inspecting the ejection parts on the basis of a detection value from the detection function, the ejection parts being classified into a plurality of ranks for inspection according to the characteristics of individual ejection parts, each rank being configured to classify the ejection parts based on a predetermined reference.

* * * * *